US011897713B2

(12) United States Patent
Toney

(10) Patent No.: US 11,897,713 B2
(45) Date of Patent: Feb. 13, 2024

(54) ASSEMBLY SYSTEM AND METHOD FOR PACKAGING WEB MATERIAL IN A ROLL

(71) Applicant: REYNOLDS CONSUMER PRODUCTS LLC, Lake Forest, IL (US)

(72) Inventor: Kenneth A. Toney, Jacksonville, IL (US)

(73) Assignee: REYNOLDS CONSUMER PRODUCTS LLC, Lake Forest, IL (US)

( * ) Notice: Subject to any disclaimer, the term of this patent is extended or adjusted under 35 U.S.C. 154(b) by 983 days.

(21) Appl. No.: 16/841,386

(22) Filed: Apr. 6, 2020

(65) Prior Publication Data

US 2020/0317459 A1 Oct. 8, 2020

Related U.S. Application Data

(60) Provisional application No. 62/829,488, filed on Apr. 4, 2019.

(51) Int. Cl.
*B65H 18/02* (2006.01)

(52) U.S. Cl.
CPC ..... *B65H 18/023* (2013.01); *B65H 2301/15* (2013.01); *B65H 2301/412* (2013.01);
(Continued)

(58) Field of Classification Search
USPC ..... 242/595, 595.1, 535.1, 528
See application file for complete search history.

(56) References Cited

U.S. PATENT DOCUMENTS 1,882,219 A 10/1932 Harwood et al.
1,987,141 A * 1/1935 Casper ..... B21C 47/06 242/596.7

(Continued)

FOREIGN PATENT DOCUMENTS

DE 2345259 a1 3/1975
EP 3 792 400 * 3/2021
WO WO 01/16008 A1 3/2001

OTHER PUBLICATIONS

International Search Report, dated Jun. 12, 2020 for International Application No. PCT/US20/26902.

(Continued)

*Primary Examiner* — William A. Rivera
(74) *Attorney, Agent, or Firm* — Baker Botts L.L.P.

(57) ABSTRACT

Rolling assembly for packaging web material in a roll having a base member with concave arcuate feed surface defining an upwardly-extending ramp, first intermediate member movably coupled to base member, and top member moveably coupled to at least one of base member or first intermediate member, top member having a concave arcuate pressure surface facing feed surface of base member. The base member, first intermediate member and top member collectively forming an iris with a feed space, the iris moveable between a first condition and a second condition, and configured to receive web material along the feed surface and direct the web material upwardly toward the top member to form a roll within the feed space, the iris moving toward a second condition as the roll of web material increases in cross dimension against the pressure surface of the top member.

20 Claims, 14 Drawing Sheets

(52) U.S. Cl.
CPC ..... *B65H 2301/4137* (2013.01); *B65H 2301/41358* (2013.01); *B65H 2301/41422* (2013.01)

(56) References Cited

U.S. PATENT DOCUMENTS

| | | | | | |
|---|---|---|---|---|---|
| 2,231,400 | A | | 2/1941 | Washburn et al. | |
| 2,270,043 | A | | 1/1942 | Fourness et al. | |
| 3,228,620 | A | | 1/1966 | Lee | |
| 3,501,106 | A | | 3/1970 | Case | |
| 3,964,232 | A | * | 6/1976 | Bender | B65H 18/22 53/118 |
| 4,206,885 | A | * | 6/1980 | Salvino | B65H 75/02 242/595.1 |
| 4,211,374 | A | * | 7/1980 | Salvino | B65H 75/02 242/595.1 |
| 4,246,817 | A | * | 1/1981 | Marsh | B65H 35/0006 83/563 |
| 4,445,356 | A | * | 5/1984 | Chubb | B21D 5/042 242/566 |
| RE31,795 | E | | 1/1985 | Rohrbacher | |
| 4,592,518 | A | * | 6/1986 | Chubb | B21D 5/042 242/129 |
| 4,784,345 | A | * | 11/1988 | Romanowski | B65H 29/70 242/541.2 |
| 4,807,825 | A | | 2/1989 | Elsner et al. | |
| 4,832,130 | A | | 5/1989 | Brouwer et al. | |
| 5,011,093 | A | * | 4/1991 | Mayer | B65H 19/2276 83/279 |
| 5,669,575 | A | * | 9/1997 | Byle | B65H 75/4402 242/470 |
| 6,186,436 | B1 | * | 2/2001 | Selle | B65H 19/2276 242/532.2 |
| 6,450,686 | B1 | | 9/2002 | May | |
| 7,182,287 | B2 | * | 2/2007 | Denker | B21C 47/24 242/533.3 |
| 2013/0189057 | A1 | * | 7/2013 | Motz | A01G 20/15 414/501 |
| 2017/0341798 | A1 | | 11/2017 | Hawkins | |

OTHER PUBLICATIONS

Extended European Search Report dated Jun. 5, 2023 in Application No. EP 20783707.

* cited by examiner

ASSEMBLY SYSTEM AND METHOD FOR PACKAGING WEB MATERIAL IN A ROLL

CROSS-REFERENCE TO RELATED APPLICATION

This application claims priority to U.S. Provisional Application Ser. No. 62/829,488 filed Apr. 4, 2019, the content of which is hereby incorporated by reference in its entirety.

BACKGROUND

Field of the Disclosed Subject Matter

The presently disclosed subject matter relates generally to a rolling assembly, and related system and method of using the same, for packaging web material in a roll for transport, storage, and commercialization.

Description of Related Art

A wide variety of web materials are commercialized for various uses. For example, bags and resealable packages for containing materials such as food, household items, and waste are often formed from webs of plastic material. Such packages are inexpensive, lightweight, and easily manufactured in large quantities.

Often web materials, or the products produced therefrom, need to be transported, stored, or commercialized. One known solution is to create a roll of the web material. For example, the web material can be rolled around a shaft or spindle. However, transporting or packaging the web material with a shaft or spindle is not always desirable. For example, the shaft or spindle may add material costs, create additional waste, and increase the weight of the finished roll of web material.

Web material can be rolled without the use of a shaft or spindle; however, known methods can result in a roll that is loosely rolled, or which has a larger diameter for a given amount of web material than desired. Therefore, there continues to be a need for improved assemblies, systems, and methods for packaging web materials in a tight roll for efficient transport, packaging, and commercialization.

SUMMARY

The purpose and advantages of the disclosed subject matter will be set forth in and apparent from the description that follows, as well as will be learned by practice of the disclosed subject matter. Additional advantages of the disclosed subject matter will be realized and attained by the assemblies, methods, and systems particularly pointed out in the written description and claims hereof, as well as from the appended drawings.

To achieve these and other advantages, and in accordance with the purpose of the disclosed subject matter, as embodied and broadly described, the disclosed subject matter includes a rolling assembly for packaging web material in a roll. The rolling assembly has a base member with a concave arcuate feed surface defining an upwardly-extending ramp and a first intermediate member moveably coupled to the base member. The assembly further includes a top member moveably coupled to at least one of the base member or the first intermediate member. The top member has a concave arcuate pressure surface facing the feed surface of the base member. The base member, the first intermediate member and the top member form an iris with a feed space defined between the feed surface and the pressure surface. The iris is moveable between a first condition and a second condition, and the feed space has a first cross dimension in side view between the feed surface and the pressure surface in the first condition. The feed space has a second cross dimension in side view between the feed surface and the pressure surface when the iris is in the second condition. The second cross dimension is greater than the first cross dimension. The iris is configured in the first condition to receive web material along the feed surface and direct the web material upwardly toward the top member to form a roll within the feed space. The iris is configured to move toward the second condition as the roll of web material increases in cross dimension against the pressure surface of the top member.

The disclosed subject matter also includes a system for packaging web material in a roll. The system includes a feed assembly configured to carry a stream of web material, and a rolling assembly proximate the feed assembly and configured to receive a stream of web material. In accordance with the disclosed subject matter, the rolling assembly includes the features described above.

The disclosed subject matter also includes a method of packaging web material in a roll. Methods in accordance with the disclosed subject matter include providing a rolling assembly configured to receive a stream of web material. In accordance with the disclosed subject matter, the rolling assembly includes the features described above. Methods in accordance with the disclosed subject matter further include delivering a stream of web material to the assembly. The iris of the rolling assembly receives the web material along the feed surface and directs the web material upwardly toward the top member to form a roll within the feed space. The iris moves toward the second condition as the roll of web material increases in cross dimension against the pressure surface of the top member.

As recognized in the art, the assemblies, systems, and methods disclosed herein can include some or all of the features described herein, or any suitable combination thereof. It is to be understood that both the foregoing general description and the following detailed description are exemplary and are intended to provide further explanation of the disclosed subject matter claimed.

The accompanying drawings, which are incorporated in and constitute part of this specification, are included to illustrate and provide a further understanding of the containers and methods of the disclosed subject matter. Together with the description, the drawings serve to explain the principles of the disclosed subject matter.

DETAILED DESCRIPTION

Figure 1:
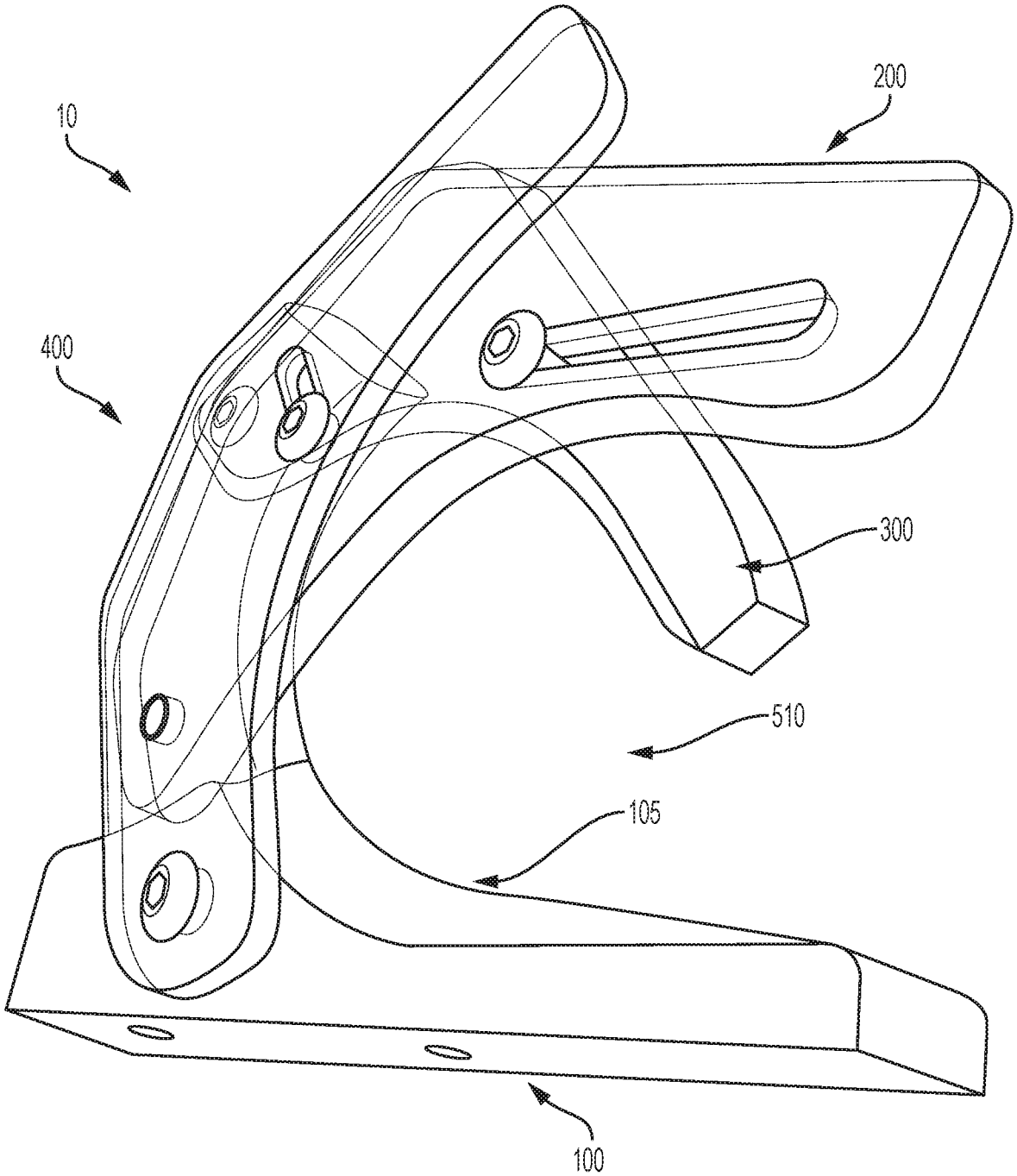
FIG. 1 is a perspective view of an exemplary embodiment of a rolling assembly for packaging web material in accordance with the disclosed subject matter.
Figure 2:
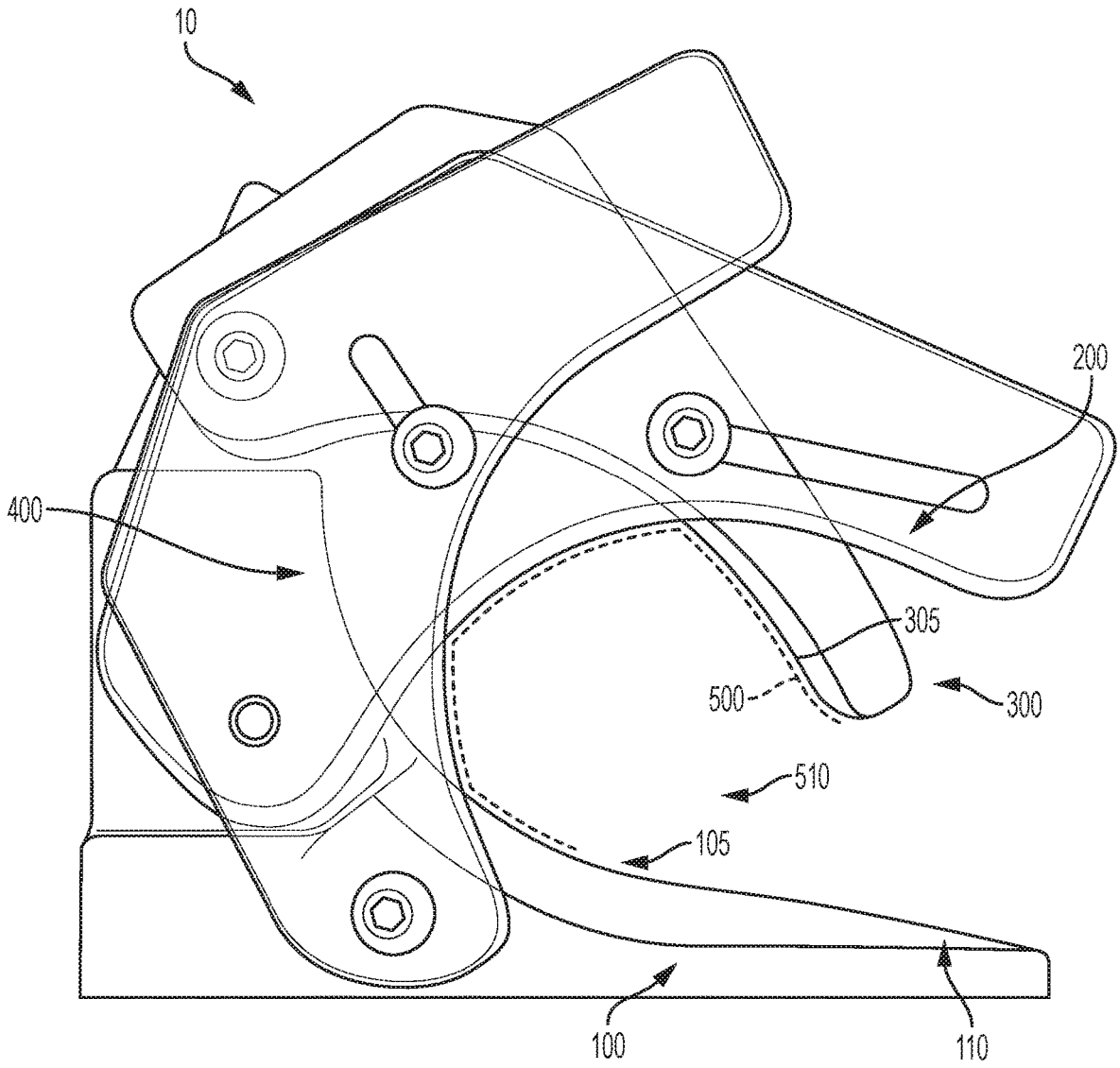
FIG. 2 is a side view of the rolling assembly of FIG. 1 with the iris in a first condition.

Reference will now be made in detail to the various exemplary embodiments of the disclosed subject matter, exemplary embodiments of which are illustrated in the accompanying drawings. The structure and corresponding method of operation of the disclosed subject matter will be described in conjunction with the detailed description of the rolling assembly and system.

The rolling assembly, system, and method presented herein can be used for the packaging transport, storage, and commercialization of a wide variety of web material. The disclosed subject matter is particularly suited for efficiently packaging web formed food storage containers, such as slider bags, in a roll.

In accordance with the disclosed subject matter herein, the rolling assembly generally includes a base member having a concave arcuate feed surface defining an upwardly-extending ramp and a first intermediate member moveably coupled to the base member. The assembly further includes a top member moveably coupled to at least one of the base member or the first intermediate member. The top member has a concave arcuate pressure surface facing the feed surface of the base member. The base member, the first intermediate member and the top member collectively form an iris with a feed space defined between the feed surface and the pressure surface. The iris is moveable between a first condition and a second condition, and the feed space has a first cross dimension in side view between the feed surface and the pressure surface in the first condition and a second cross dimension in side view between the feed surface and the pressure surface in the second condition. The second cross dimension is greater than the first cross dimension. The iris is configured in the first condition to receive web material along the feed surface and direct the web material upwardly toward the top member to form a roll within the feed space. The iris configured to move toward the second condition as the roll of web material increases in cross dimension against the pressure surface of the top member.

The accompanying figures, where like reference numerals refer to identical or functionally similar elements throughout the separate views, serve to further illustrate various embodiments and to explain various principles and advantages in accordance with the disclosed subject matter. For purpose of explanation and illustration, and not limitation, exemplary embodiments of the container in accordance with the disclosed subject matter are shown in FIG. 1-FIG. 14. The assembly of the disclosed subject matter is suitable for use with a wide variety of web formed articles. As used herein, the terms "front," "rear," "side," "top," and "bottom" are used for the purpose of illustration only, and not limitation. That is, it is recognized that the terms "front," "rear," "side," "top," and "bottom" are merely used herein as a point of reference, and can alter based upon perspective.

For purpose of illustration, and not limitation, reference is made to the exemplary embodiment of an assembly 10 shown in FIG. 1-FIG. 8C. In accordance with the disclosed subject matter, assembly 10 includes a base member 100, a first intermediate member 200 moveably coupled to the base member 100, and a top member 300 moveably coupled to at least one of the base member 100 or the first intermediate member 200. As described further herein, the base member 100 includes a concave arcuate feed surface 105 defining an upwardly-extending ramp, and the top member 300 includes a concave arcuate pressure surface 305 facing the arcuate feed surface 105. In accordance with the disclosed subject matter, and as described further herein, the base member 100, first intermediate member 200, and the top member 300 collectively form an iris 500 with a feed space 510 defined between the feed surface 105 and the pressure surface 305.

Figure 4B:
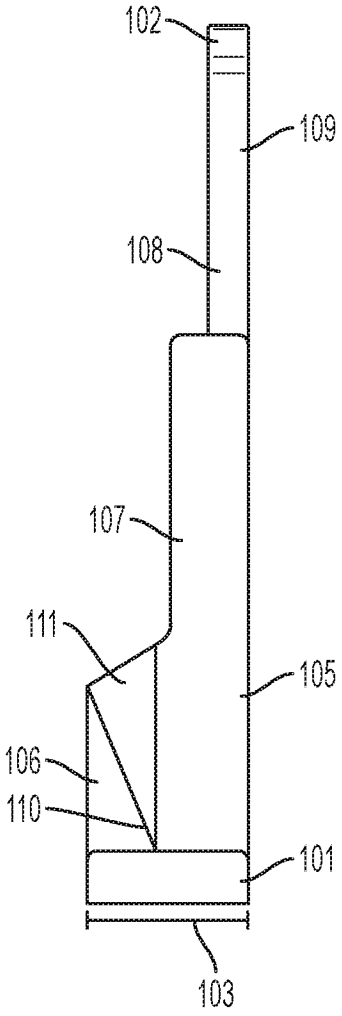
FIG. 4B is a front view of the base member of the rolling assembly of FIG. 1.
Figure 4A:
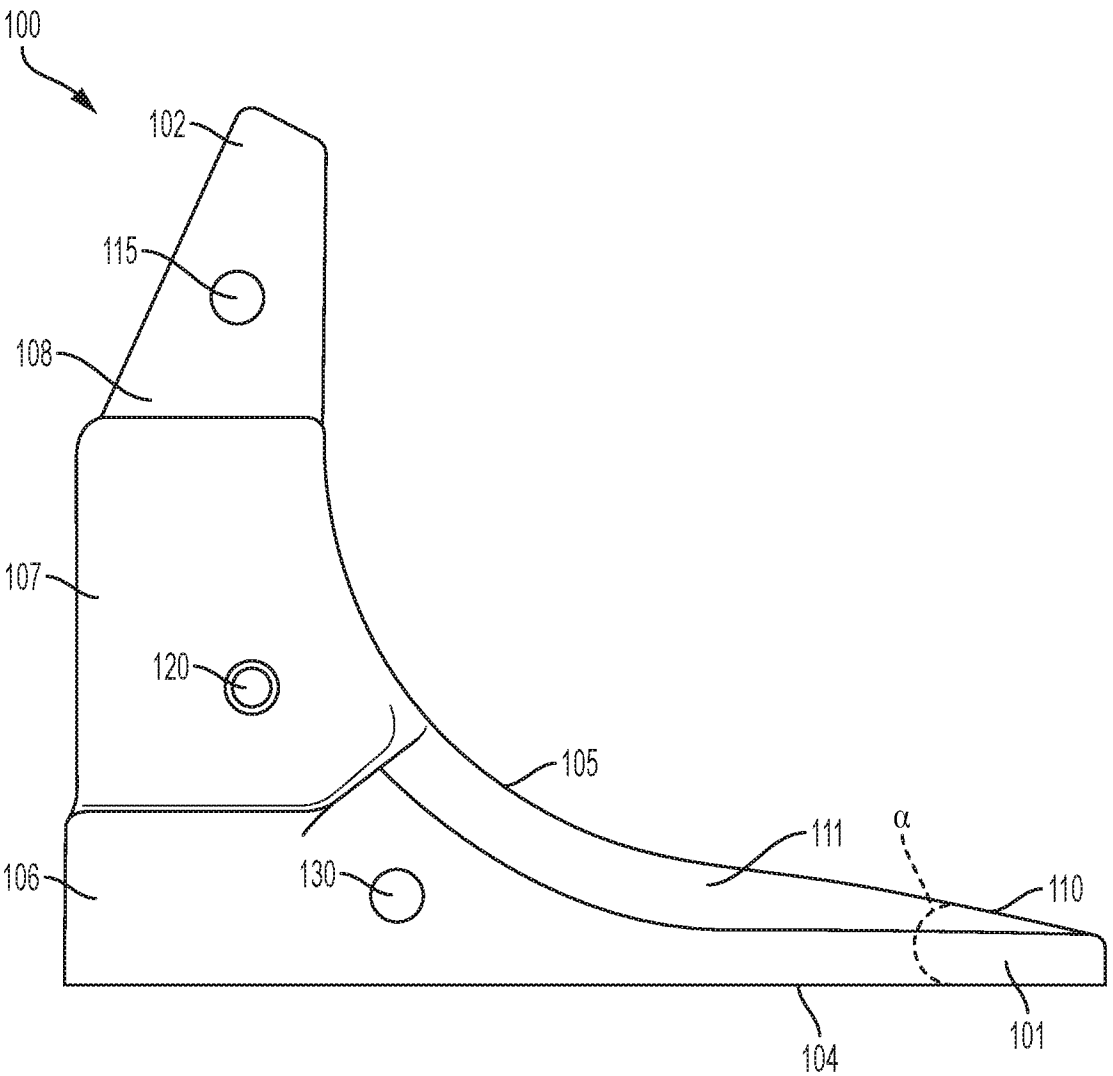
FIG. 4A is a side view of the base member of the rolling assembly of FIG. 1.

With reference to FIG. 4A, the base member 100 can have a first end 101 and a second end 102. A feed surface 105 can extend along at least a portion of the base member 100 between the first end 101 and the second end 102 to define an upwardly-extending ramp. As embodied herein, the feed surface 105 can have a radius of curvature and can define a crescent-like shape in side view. The radius of curvature can be a constant radius of curvature, or the radius of curvature can be complex, such that the radius of curvature varies between the first end 101 and the second end 102. As described further herein, the radius of curvature of the feed surface 105 can be selected according to the properties of the web formed articles to be packaged.

Additionally or alternatively, and as embodied herein, the feed surface 105 of the base member 100 can include an angled or sloped region 110, which can extend along at least a portion of the feed surface 105 between the first end 101 and the second end 102. The angled or sloped region 110 can be disposed at an angle $\alpha$ in side view relative to a bottom edge 104 of the base member 100, as shown in FIG. 4A. Additionally, and as further embodied herein, the base member 100 can have a width dimension 103 in end view, such as depicted in the front view of FIG. 4B. Furthermore, and as embodied herein, the feed surface 105 can include chamfered edges 111 along one or more sections of the feed surface, such as between an outer face of tier 106 towards a center region 109.

Further referencing FIG. 4B, the base member 100 can include one or more tiers different from each other in end view, each of which can facilitate the articulating motion of a respective one of the top member 300 and one or more intermediate members 200, 400, as further described herein. In accordance with one aspect of the disclosed subject matter, and as embodied herein, the base member 100 can include an outer tier 106, a middle tier 107, and a lower tier 108, each defining a respective outer surface portion of the base member 100. For purpose of example and not limitation, and as embodied herein, outer tier 106 can extend to a portion proximate the first end 101 of the base member 100 and lower tier 108 can be disposed proximate a second end 102 of the base member with middle tier 107 disposed in a region therebetween. The distance or depth between adjacent outer surface portions of the base member 100, as defined by each respective tier can be selected based on the thickness of the corresponding top member or intermediate members to be coupled thereto, as further described herein. As further embodied herein, the base member 100 can also include connection points 115, 120, and 130, which can be used to couple the top member 300 and one or more intermediate members 200, 400 to the base member 100, as further described herein. For purpose of example, and not limitation, and as embodied herein, the connection points can define one or more holes which can receive a fastener, such as a bolt, screw, peg, nail, rivet, or the like. Alternatively, such fasteners can be formed integral with the base member.

Figure 5:
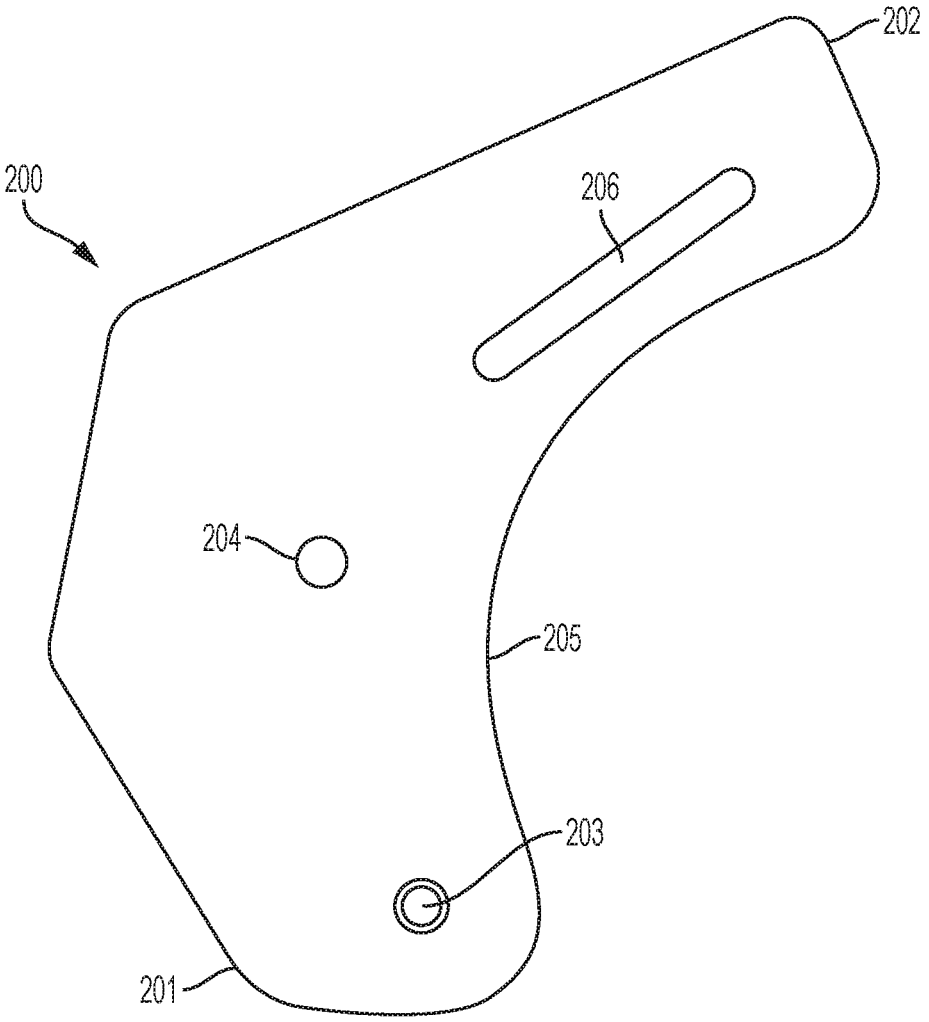
FIG. 5 is a side view of the first intermediate member of the rolling assembly of FIG. 1.

With reference to FIG. 1 and FIG. 5, the assembly 10 further includes a first intermediate member 200 moveably coupled to the base member 100. For example, and as embodied herein, the first intermediate member can be pivotally connected to the base member 100 as depicted in the exemplary embodiment of FIG. 1-FIG. 8C. For purpose of example, and as embodied herein, the first intermediate member 200 can include a connection point 203 and the first intermediate member 200 can be pivotally connected to the base member 100 at connection point 203. For purpose of example, and not limitation, connection point 203 can define one or more holes configured to receive a fastener, such as a bolt, screw, peg, nail, or rivet to pivotally connect the first intermediate member 200 to the bottom member 100. The intermediate member can further include a first end 201 and a second end 202.

In accordance with another aspect of the disclosed subject matter, and as further embodied herein, the first intermediate member 200 can include a connection point 204 such as depicted in the exemplary embodiment of FIG. 1-FIG. 8C. Connection point 204 can be configured, for example, to slidably connect the first intermediate member 200 with a second intermediate member 400, as further described herein. Additionally, or alternatively, and in accordance with another aspect of the disclosed subject matter, the first intermediate member 200 can also include a slot 206 to facilitate movement of the first intermediate member 200 relative to the top member 300. For purpose of example, and as embodied herein, slot 206 can be configured to slidably connect the first intermediate member 200 with the top member 300.

In accordance with another aspect of the disclosed subject matter, and as described further herein, the intermediate member 200 can include an arcuate first intermediate pressure surface 205 extending along at least a portion of the intermediate member 200 between the first end 201 and the second end 202. As described previously with respect to the feed surface 105, the first intermediate pressure surface 205 can have a radius of curvature to define a crescent-like shape in side view. The radius of curvature can be a constant radius of curvature, or complex. As embodied herein, and as described further below, the first intermediate member 200 collectively with the base member 100 and top member 300 can define an iris 500 to apply pressure on the roll of web material 25 as the roll increases in cross dimension and the iris 500 expands from a first condition to a second condition.

Figure 6:
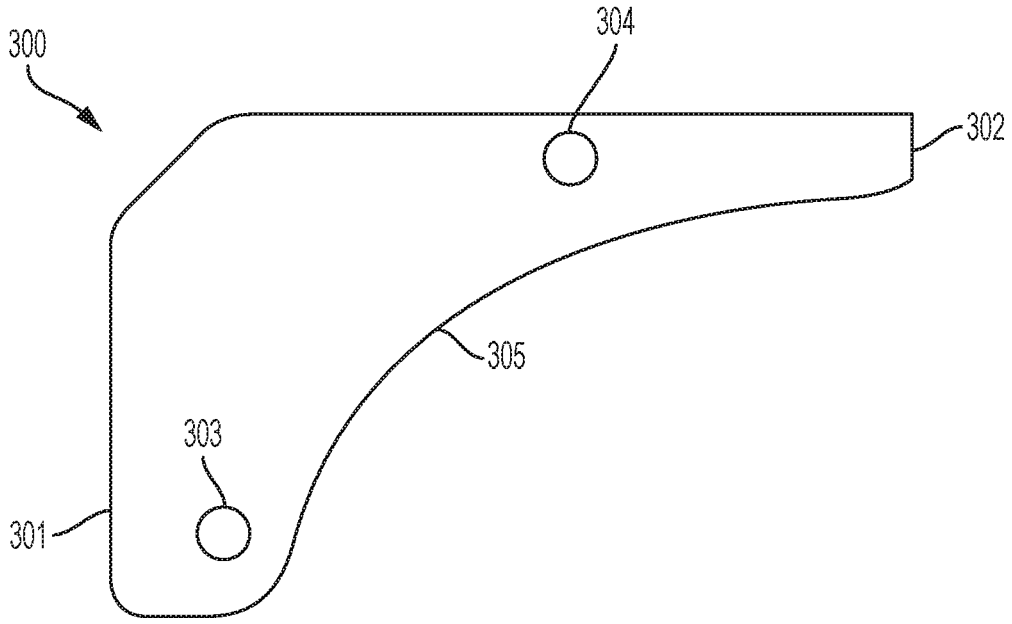
FIG. 6 is a side view of the top member of the rolling assembly of FIG. 1.

With reference to FIG. 1 and FIG. 6, the rolling assembly 10 further includes a top member 300 moveably coupled to at least one of the base member 100 and the first intermediate member 200. In accordance with the disclosed subject matter, the top member 300 includes a pressure surface 305. As embodied herein, the top member can include a first end 301 and a second end 302, and the pressure surface 305 can extend along at least a portion of the top member between the first end 301 and the second end 302. In accordance with the disclosed subject matter, and with reference to FIG. 1, the pressure surface 305 of the top member 300 faces the feed surface 105 of the base member 100. As embodied herein, the pressure surface 305 can have a radius of curvature to define a crescent-like shape in side view. As previously noted with respect to the base member 100, the radius of curvature of the arcuate pressure surface 305 can be constant or complex. For purpose of example and not limitation, the radius of curvature of the top member 300 can be approximately 2" to approximately 5". As further embodied herein, the pressure surface 305 can have a width dimension, which can include chamfered edge portions along some or all of the length if desired. For purpose of example and not limitation, the pressure surface 305 can have a width dimension of between approximately 0.5" and approximately 0.75".

In accordance with the disclosed subject matter, the top member 300 can be moveably coupled to at least one of the base member 100 or the first intermediate member 200. For example, the top member can be pivotally connected to the base member 100. For purpose of example, and as embodied herein, the top member 300 can include connection point 303, which can define one or more holes configured to receive a fastener, such as a bolt screw, peg, nail, or rivet, to pivotally connect the top member 300 to the base member 100. In accordance with another aspect of the disclosed subject matter, and as described further herein, the top member 300 can further include a second connection point 304, as described further below.

In accordance with the disclosed subject matter, the base member 100, first intermediate member 200, and the top member 300 collectively form an iris 500 with a feed space 510 defined between the feed surface 105 and the pressure surface 305. The iris 500 is depicted in broken line in FIGS. 2 and 3 for purpose of illustration only. As described further herein, the iris 500 is moveable between a first condition and a second condition. Referencing FIG. 8A, the iris 500 of the exemplary embodiment of FIG. 1-FIG. 8C is depicted in a first condition. In accordance with the disclosed subject matter, the feed space 510 has a first cross dimension in side view measured between the arcuate feed surface 105 and the arcuate pressure surface 305 when the iris 500 is in a first condition.

Figure 8B:
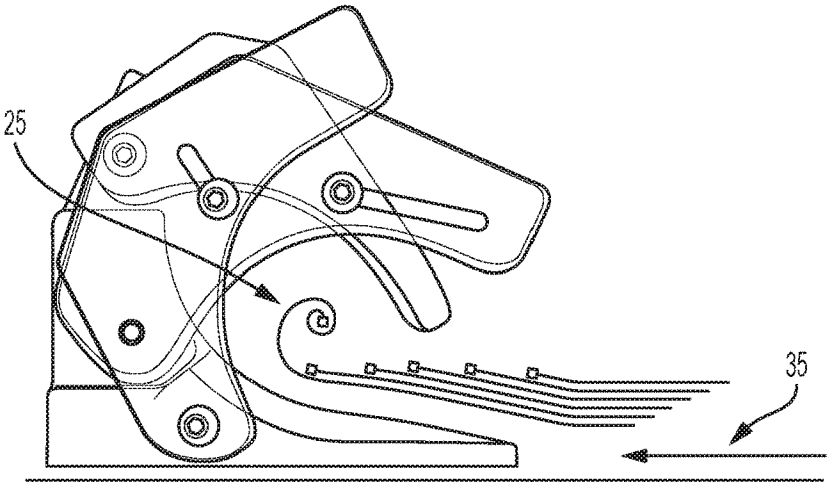
FIG. 8B is a side view of the rolling assembly of FIG. 8A with the iris in a first condition forming a roll of web material within the feed space.
Figure 8A:
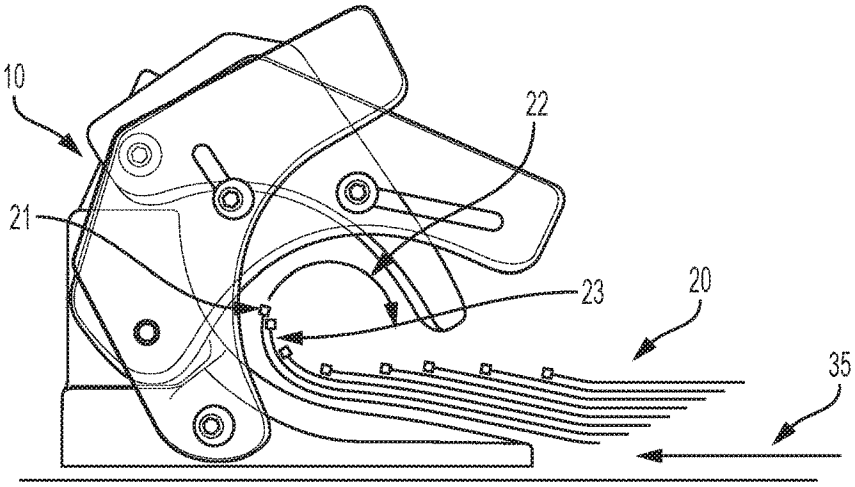
FIG. 8A is a side view of the rolling assembly of FIG. 1 with the iris in a first condition to receive a stream of web material in a shingled arrangement.
Figure 8C:
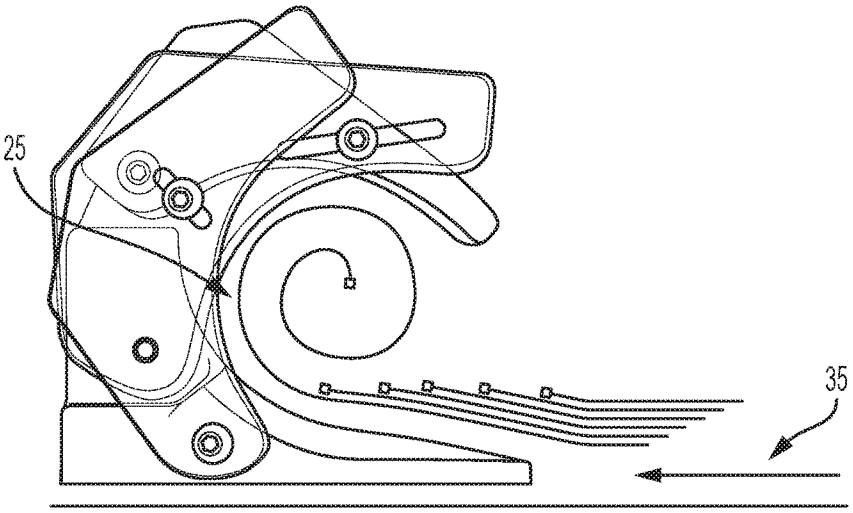
FIG. 8C is a side view of the rolling assembly of FIG. 8A with the iris moving toward a second condition as the roll of web material increases in cross dimension.

Further referencing FIG. 8A, the iris 500 is configured in the first condition to receive web material 20 along the arcuate feed surface 105. In accordance with the disclosed subject matter, the iris 500 is configured to direct the web material 20 from the first end 101 upwardly toward the top member 300 to form a roll 25 within the feed space 510. For purpose of example, and not limitation, directional arrow 22 indicates the direction of movement of the web material 20 within the feed space 510. With reference to FIG. 8A and FIG. 8B, the leading edge 21 of the web material 20 is first directed upwardly by the shape of the iris 500 in the first condition, and then wrapped back to fold over onto the top of the adjacent web material 20 to initiate a roll 25.

Figure 3:
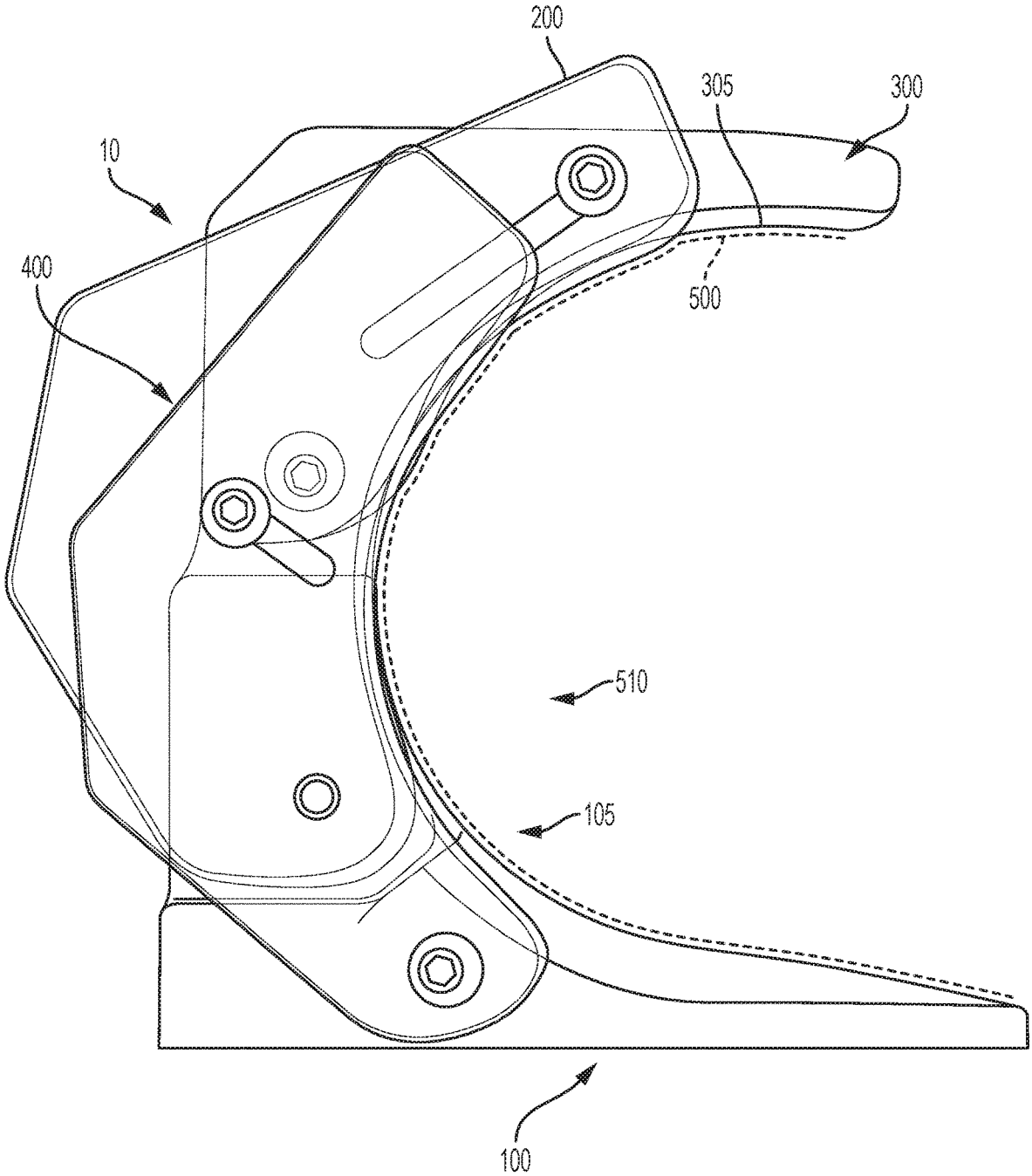
FIG. 3 is a side view of the rolling assembly of FIG. 1 with the iris in a second condition.

In accordance with the disclosed subject matter, the roll 25 can increase in cross dimension as the web material 20 continues to enter the feed space 510 in the direction indicated by arrow 35. The iris 500 moves towards a second condition as the roll of web material 25 increases in cross dimension against the pressure surface 305 of the top member 300. With reference to FIG. 3, the iris 500 of the exemplary embodiment of FIG. 1-FIG. 8C is depicted in a second condition, and in accordance with the disclosed subject matter, a second cross dimension can be measured in side view between the feed surface 105 and the pressure surface 305 when the iris 500 is in a second condition. The second cross dimension is greater than the first cross dimension of the feed space measured when the iris 500 is in a first condition.

Additionally, and in accordance with the disclosed subject matter, the iris 500 can be configured to apply pressure to the roll of web material 25 as the iris moves between a first condition and a second condition. For purpose of example, and not limitation, the amount of pressure the iris 500 applies to the roll 25 can be controlled in a number of ways, such as by selecting the weight of the top member 300, incorporating a spring bias between the various members, or by adjusting the friction fit between the various members. As discussed further herein, weight of the top member 300 can be controlled by adding one or more ballast weights to the top member. Additionally or alternatively, the material of the top member 300 can be selected to achieve the desired weight and apply the desired pressure to the roll of web material 25 as the iris moves between the first condition and the second condition. For example, and as embodied herein, the top member 300 can be formed of steel.

Additionally, and as embodied herein, friction fit between members can be adjusted by adjusting the tightness of fasteners connecting the first intermediate member 200 to the base member and connecting the top member 300 to at least one of the first intermediate member 200 or the base member 100. Adjusting the tightness of the fasteners can control the force required to move the iris 500 from a first condition to a second condition as the roll of web material 25 increases in cross dimension. For purpose of example, and as embodied herein, the bolts pivotally connecting the first intermediate member 200 and the top member 300 to the base member can be tightened to increase the amount of pressure the iris 500 exerts on the roll of web material 25 as the roll increases in cross dimension against the arcuate pressure surface of the top member.

Figure 7:
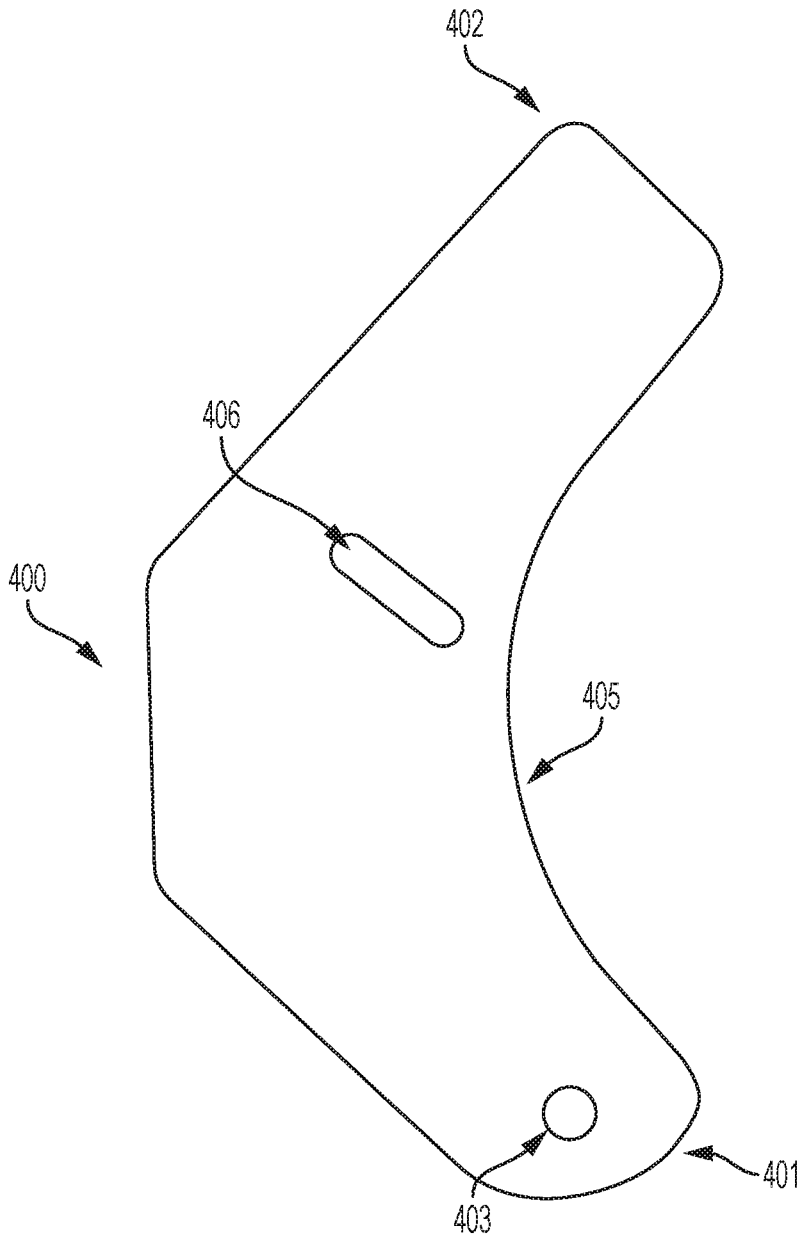
FIG. 7 is a side view of the second intermediate member of the rolling assembly of FIG. 1.

In accordance with another aspect of the disclosed subject matter, and as further embodied in the exemplary embodiment of FIG. 1-FIG. 8C, the assembly 10 can further include a second intermediate member 400 moveably coupled to the base member 100. As embodied herein, the second intermediate member 400 can further define the movement of the iris 500 and the rolling assembly 10. With reference to FIG. 7, and as embodied herein, the second intermediate member can include a first end 401 and a second end 402. An arcuate second intermediate pressure surface 405 can extend along at least a portion of the second intermediate member 400 between the first end 401 and the second end 402. As described above with respect to the feed surface 105, the second intermediate pressure surface 405 can have a radius of curvature to define a substantially crescent-like shape in side view. The radius of curvature can be a constant radius of curvature, or complex. As embodied herein, the second intermediate pressure surface 405 can further define the iris 500 and can apply pressure on the roll of web material 25 as the roll increases in cross dimension and the iris 500 expands from a first condition to a second condition.

In accordance with another aspect of the disclosed subject matter, and as further embodied in the exemplary embodiment of FIG. 1-FIG. 8C, the first intermediate member 200, second intermediate member 400 and top member 300 can each be pivotally connected to the base member. For example, and as embodied herein, the top member 300 can be pivotally connected at lower tier 108, the first intermediate member 200 can be pivotally connected at middle tier 107, and the second intermediate member 400 can be pivotally connected at outer tier 106. In this manner, the top member 300, the first intermediate member 200, and the second intermediate member 400 can be stacked relative to each other and free to move and/or pivot relative to the base member without interfering with the other members.

As embodied herein, the top member 300 can be pivotally connected by connection points 115 and 303 on lower tier 108, the first intermediate member can be connected by connection points 120 and 203 on middle tier 107 of the base member 100, and the second intermediate member 400 can be pivotally connected by connection points 130 and 403 on outer tier 106. As described above, the depth of each tier on the base member 100 can correspond to a thickness dimension of the respective intermediate member or top member such that the intermediate and top members can pivot with respect to the base member 100 without interfering with one another.

In accordance with another aspect of the disclosed subject matter, and as further embodied in the exemplary embodiment of FIG. 1-FIG. 8C, the top member 300 and/or the second intermediate member 400 can each be slidably connected to the first intermediate member 200. For purpose of example, and as embodied herein, the top member 300 can include a connection point 304 which can define a hole configured to receive a fastener, such as a bolt, screw, peg, pin, nail, or rivet, that slidably interfaces with slot 206 in the first intermediate member 200. Furthermore, the first intermediate member 200 can include a connection point 204 and a slot 206. Connection point 204 can include a fastener, such as a bolt, screw, peg, pin, nail, or rivet, that slidably interfaces with a slot 406 in the second intermediate member 400. The slidable connections between the top member 300, second intermediate member 400, and first intermediate member 200 can further define the motion of the iris 500 as the iris 500 moves from a first condition to a second condition.

Figure 9B:
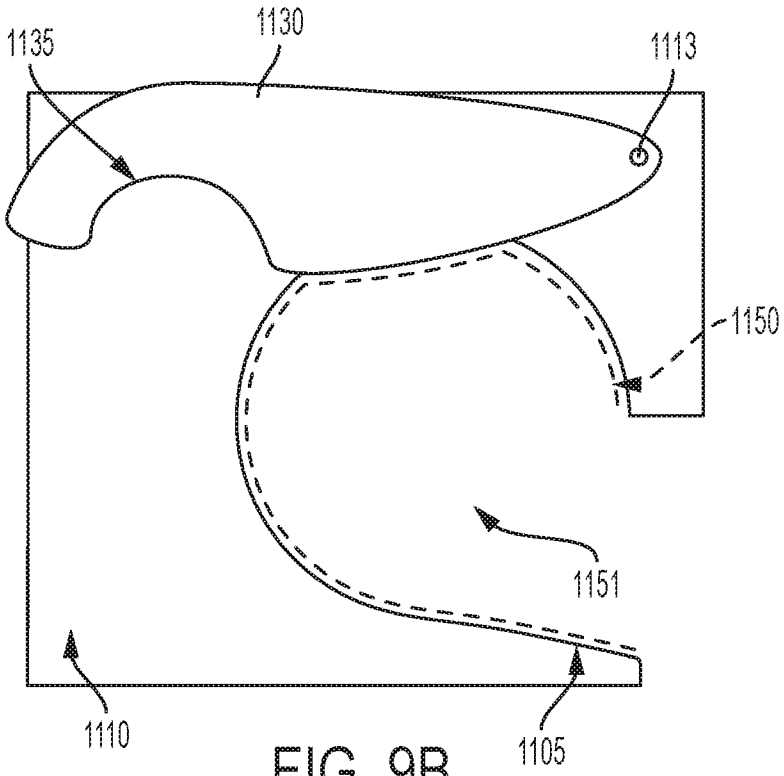
FIG. 9B is a side view of the rolling assembly of FIG. 9A with the iris in a second condition.
Figure 9A:
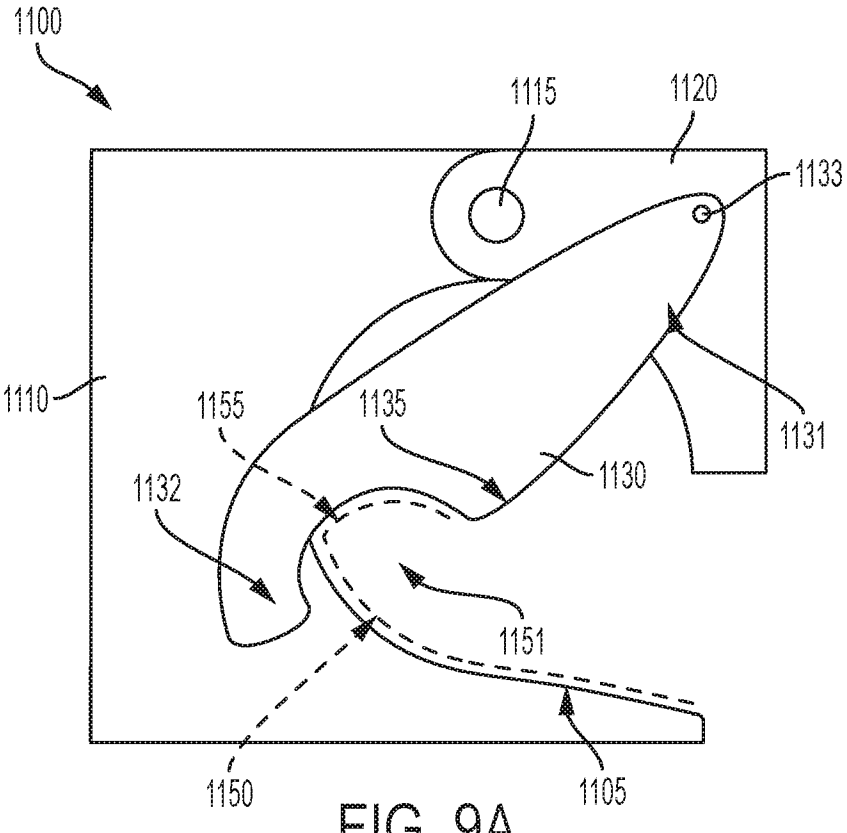
FIG. 9A is a side view of another exemplary embodiment of a rolling assembly for packaging web material in accordance with the disclosed subject matter with the iris in a first condition.

In accordance with another aspect of the disclosed subject matter, and with reference to the exemplary rolling assembly 1100 depicted in FIGS. 9A and 9B, the first intermediate member 1120 can be pivotally connected to the base member 1110, and the top member 1130 can be pivotally connected to the first intermediate member 1120 to define iris 1150 therebetween. For example, top member 1130 can include a first end 1131 pivotally connected to the intermediate member 1120 and a free end 1132 with a concave arcuate pressure surface 1135 therebetween.

In accordance with the disclosed subject matter, the base member 1110, the first intermediate member 1120 and the top member 1130 collectively form an iris 1150 with a feed space 1151 defined between the feed surface 1105 and the pressure surface 1135. The iris 1150 of the exemplary rolling assembly 1100 is moveable between a first condition, as depicted in FIG. 9A, and a second condition, as depicted in 9B. With reference to FIG. 9A, the feed space 1151 has a first cross dimension in side view between the feed surface 1105 and the pressure surface 1135 in the first condition. With reference to FIG. 9B, the feed space 1151 has a second cross dimension in side view between the feed surface 1105 and the pressure surface 1135 in the second condition, the second cross dimension being greater than the first cross dimension. The iris 1150 is configured to receive web material along the feed surface 1105 of the base member 1110 in the first condition and direct the web material upwardly toward the top member 1130 to form a roll within the feed space 1151. The iris 1150 is configured to move toward the second condition as the roll of web material increases in cross dimension against the pressure surface 1135 of the top member 1130.

In accordance with another aspect of the disclosed subject matter, the rolling assembly 1100 can be moveable to an extraction condition. For purpose of example and as embodied herein, the first intermediate member 1120 can pivot about connection point 1115 on base member 1110 to extract a finished roll of web material from the rolling assembly 1100. The free end 1132 of the top member 1130 can be configured to urge the roll of web material out of the feed space 1151 when the rolling assembly is moved toward the extraction condition.

In accordance with another aspect of the disclosed subject matter, and as further embodied herein, the pressure surface 1135 of the top member 1130 can include a roll-initiating notch 1155. The notch 1155 can help direct the web material upwardly to initiate the formation of a roll with a small cross-sectional diameter within the feed space 1151.

Figure 10B:
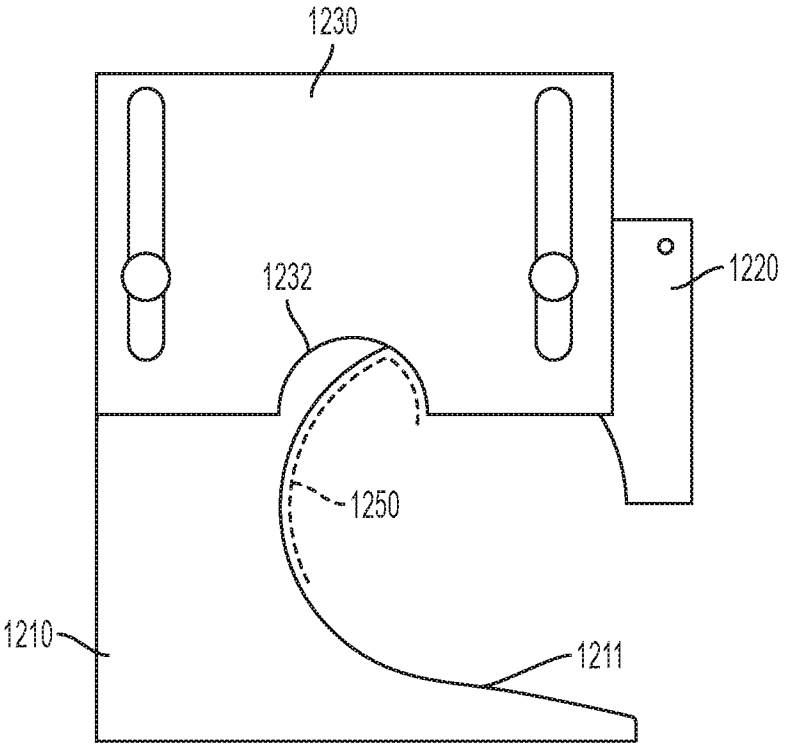
FIG. 10B is a side view of the rolling assembly of FIG. 10A with the iris in a second condition.
Figure 10A:
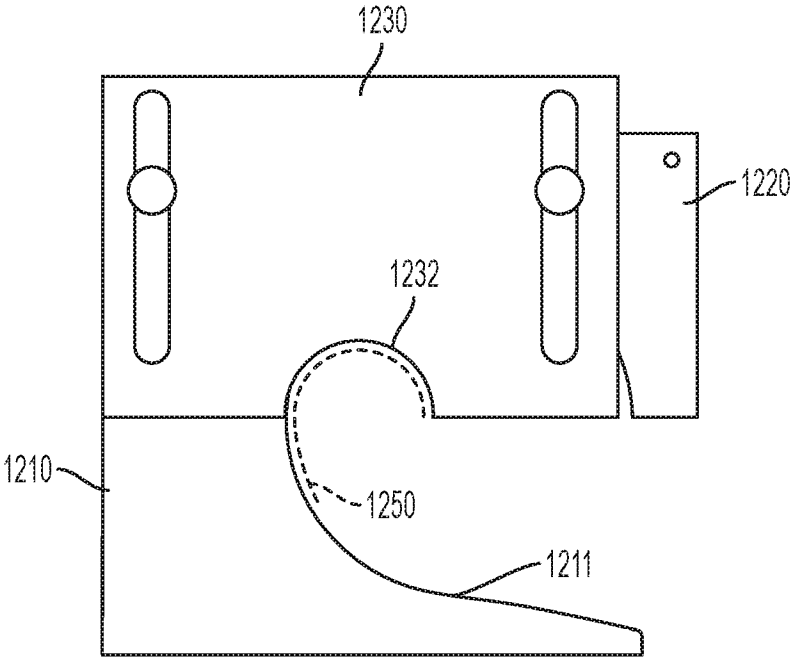
FIG. 10A is a side view of another exemplary embodiment of a rolling assembly for packaging web material in accordance with the disclosed subject matter with the iris in a first condition.

In accordance with another aspect of the disclosed subject matter, and as embodied in the exemplary embodiment of FIG. 10A and FIG. 10B, the top member 1230 can be slidably connected to the base member 1210 and the first intermediate member 1220. With reference to FIG. 10A, the iris 1250 is configured to receive web material along the feed surface 1211 in a first condition. With reference to FIG. 10B, the iris 500 is depicted in a second condition with the pressure surface 1232 of the top member 1230 moving away from the feed surface 1211. In accordance with the disclosed subject matter, the cross dimension in side view between the feed surface 1211 and the pressure surface 1232 in the second condition is greater than the cross dimension in side view when the iris 1250 is in the first condition.

Figure 11B:
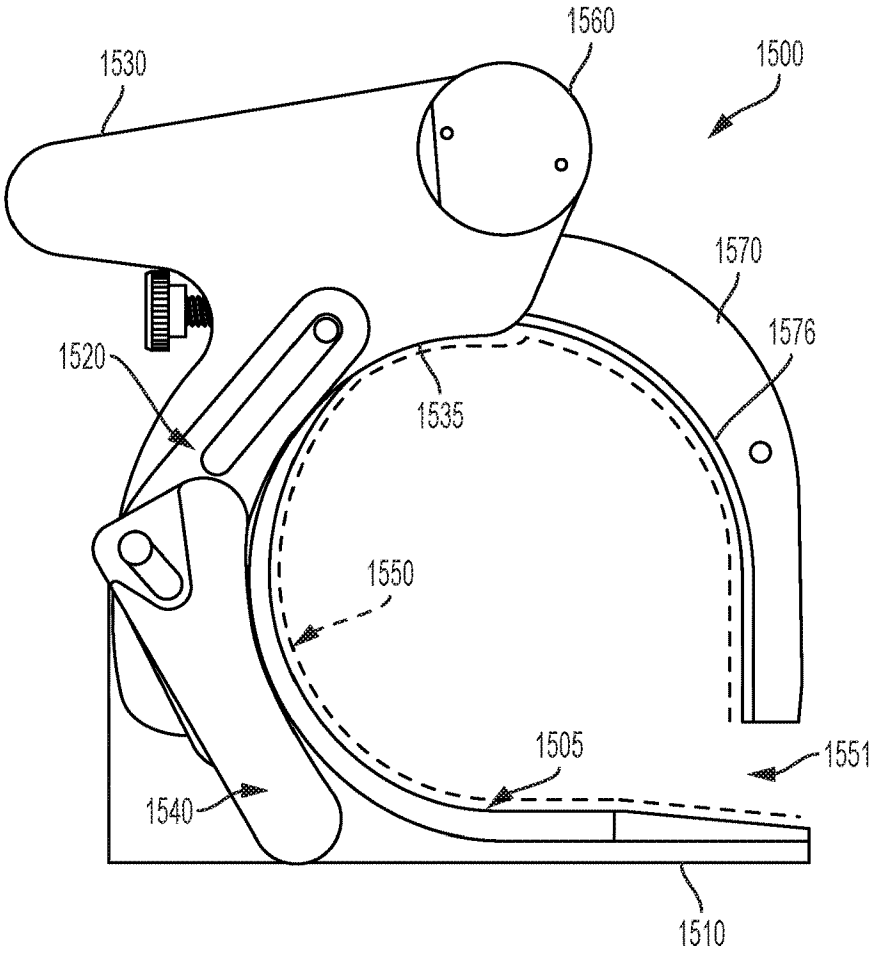
FIG. 11B is a side view of the rolling assembly of FIG. 11A with the iris in a second condition.
Figure 11A:
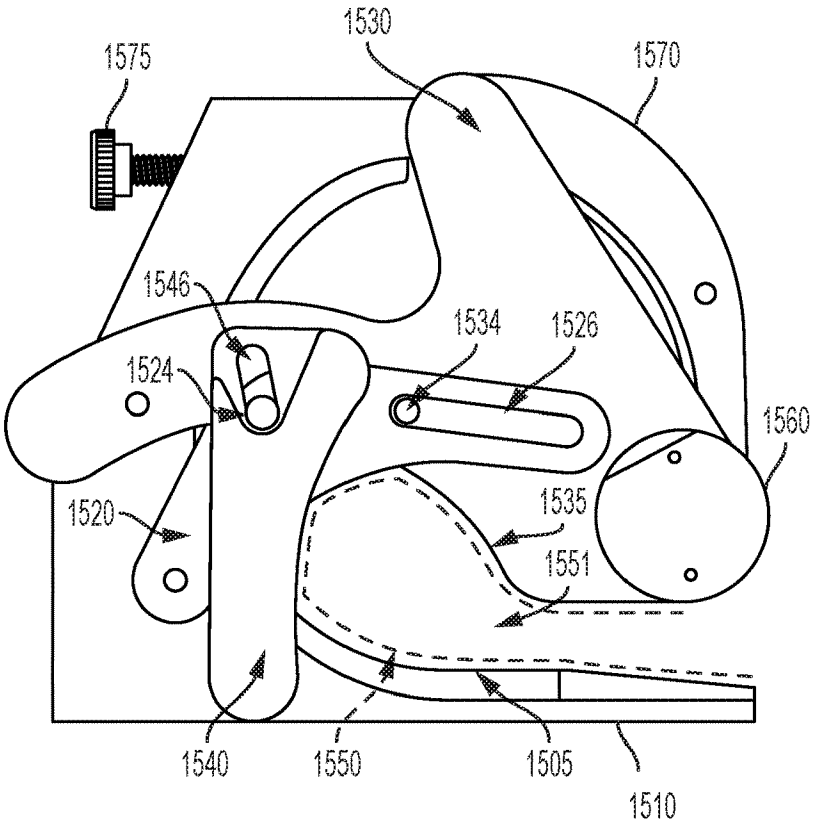
FIG. 11A is a side view of another exemplary embodiment of a rolling assembly for packaging web material in accordance with the disclosed subject matter with the iris in a first condition.

For purpose of illustration, and not limitation, reference is made to the exemplary embodiment of an assembly 1500 shown in FIG. 11A and FIG. 11B. In accordance with another aspect of the disclosed subject matter, assembly 1500 includes a base member 1510, a first intermediate member 1520 moveably coupled to the base member 1510, and a top member 1530 moveably coupled to at least one of the base member 1510 or the first intermediate member 1520. As embodied herein, the top member 1530 can be pivotally connected to the base member 1510. The base member 1510 includes a concave arcuate feed surface 1505 defining an upwardly-extending ramp, and the top member 1530 includes a concave arcuate pressure surface 1535 facing the arcuate feed surface 1505. The base member 1510, first intermediate member 1520, and the top member 1530 collectively form an iris 1550 with a feed space 1551 defined between the feed surface 1505 and the pressure surface 1535. Iris 1550 is depicted in broken line in FIGS. 11A and 11B for purpose of illustration only.

The iris 1550 is moveable between a first condition and a second condition. With reference to FIG. 11A, the exemplary assembly 1500 is depicted with the iris 1550 in a first condition. The feed space 1551 has a first cross dimension in side view between the feed surface 1505 and the pressure surface 1535 in the first condition. With reference to FIG. 11B, the assembly 1500 is depicted in a second condition. The feed space 1551 has a second cross dimension in side view between the feed surface 1505 and the pressure surface 1535 in the second condition, the second cross dimension being greater than the first cross dimension. For purpose of example and as embodied herein, the second cross dimension can be approximately 4.5 inches. The iris 1550 in the first condition is configured to receive web material along the feed surface 1505 and direct the web material upwardly toward the top member 1535 to form a roll within the feed space. The iris 1550 is configured to move toward the second condition as the roll of web material increases in cross dimension against the pressure surface 1535 of the top member 1530.

As embodied herein, the first intermediate member 1520 can include an arcuate first intermediate pressure surface configured to further define the iris 1550 and apply pressure on a roll of web material as the roll increases in cross dimension and the iris 1550 expands from the first condition to the second condition. Additionally, and as further embodied herein, the assembly 1500 can include a second intermediate member 1540 moveably coupled to the base member 1510. The second intermediate member 1540 can include an arcuate second intermediate pressure surface configured to further define the iris 1550 and apply pressure on a roll of web material as the roll increases in cross dimension and the iris 1550 expands from the first condition to the second condition.

As embodied herein, the first intermediate member 1520, the second intermediate member 1540, and the top member 1530 can each be pivotally connected to the base member 1510. As described above, the base member can include tiers or levels, and the various members can each be connected to a different tier of the base member to facilitate relative movement of the members. Additionally or alternatively, washers or spacers can be used at the connection between the base member 1510 and first intermediate member 1520 and between the base member 1510 and the second intermediate member 1540, respectively, to offset the first intermediate member 1520, second intermediate member 1540, and top member 1530 from one another in end view and facilitate movement of the members. In accordance with another aspect of the disclosed subject matter, and as embodied herein, the first intermediate member 1520 and the second intermediate member 1540 can each include a region of increased thickness where the first intermediate member 1520 and the second intermediate member 1540, respectively, connect to the base member 1510. The regions of increased thickness can create an offset between the respective members to facilitate movement of the members.

As described above, the top member 1530 and second intermediate member 1540 can each be slidably connected to the first intermediate member 1520. The slidable connections between the top member 1530, second intermediate member 1540, and first intermediate member 1520 can further define the motion of the iris 1550 as the iris moves from the first condition to the second condition. As embodied herein, the top member 1530 can include a fastener 1534, such as a bolt, screw, peg, pin, nail, or rivet, and the fastener 1534 can interface with a slot 1526 defined in the first intermediate member 1520 to slidably connect the top member 1530 to the first intermediate member 1520. As further embodied herein, the first intermediate member 1520 can include a fastener 1524, such as a bolt, screw, peg, pin, nail, or rivet, and the fastener 1524 can interface with a slot 1546 defined in the second intermediate member 1540 to slidably connect the second intermediate member 1540 to the first intermediate member 1520.

In accordance with an aspect of the disclosed subject matter, the top member 1530 of the exemplary rolling assembly 1500 can include a ballast 1560. For purpose of example, the top member 1530 can have a first end moveably coupled to at least one of the base member 1510 or the first intermediate member 1520 and a free end opposite the first end. The free end can include the ballast. As embodied herein, the first end of the top member 1530 can be pivotally connected to the base member 1510. The ballast, or weight, 1560 can be selected to adjust the amount of pressure the iris applies to the roll as the iris moves from the first condition to the second condition. Increasing the pressure the iris applies to a roll can, for example, help create tighter rolls of web material. The location and size of the ballast 1560 can be selected based on the desired performance characteristics of the assembly and the properties of the web material being rolled.

In accordance with another aspect of the disclosed subject matter, the exemplary rolling assembly 1500 can include an outer member 1570 extending from the base member 1510. For purpose of example and not limitation, outer member 1570 can be connected to the base member 1510 at an upper portion thereof. Outer member 1570 can include an arcuate outer member surface 1576, which can further apply pressure to the roll of web material as the roll of web material increases in cross dimension within the iris. For purpose of example and as embodied herein, outer member 1570 can be connected to the base member 1510 using a threaded connector 1575. Connector 1575 can be used to adjust the position of the outer member 1575 relative to the base member 1510. For purpose of example, the position of the outer member 1575 can be adjusted to define the desired diameter of a finished roll of web material. Additionally alternatively, the connector 1575 can be used to move the outer member 1575 away from the base member 1510 to remove a finished roll of web material from the iris 1550. It is to be understood that the outer member 1575 is optional, and the rolling assembly 1500 can be used without the outer member 1575.

Figure 12B:
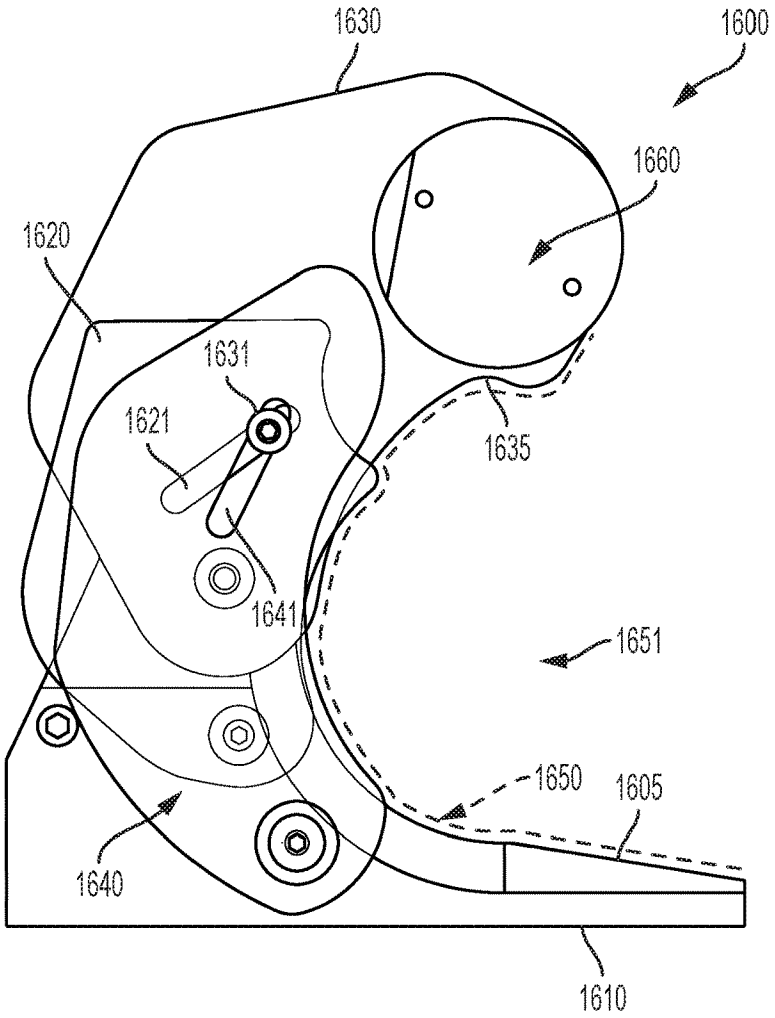
FIG. 12B is a side view of the rolling assembly of FIG. 12A with the iris in a second condition.
Figure 12A:
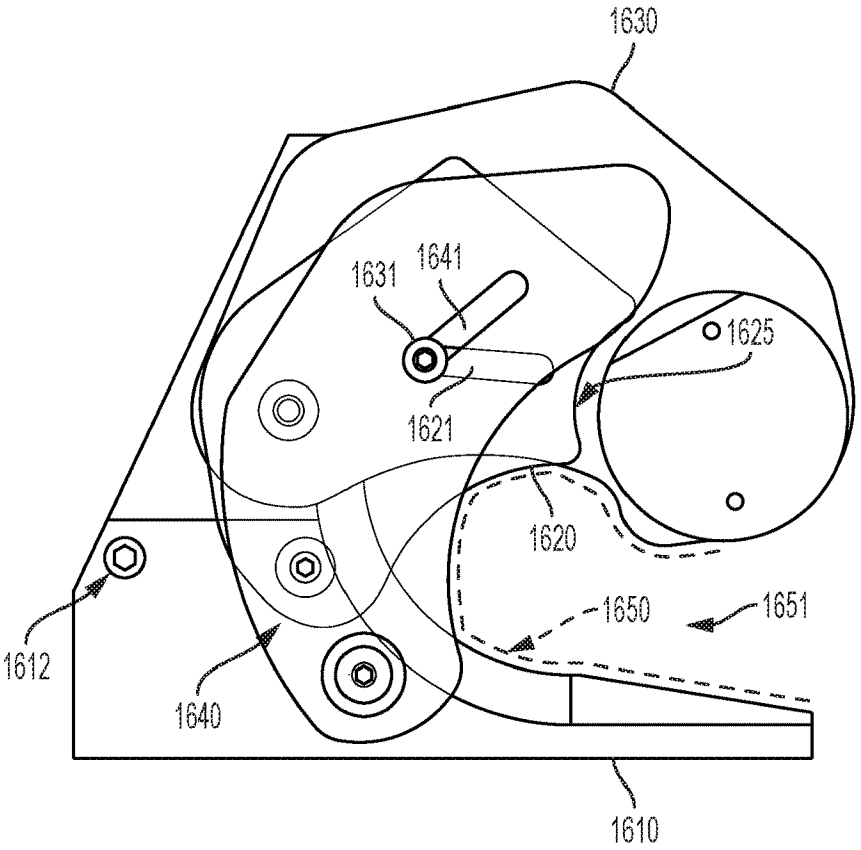
FIG. 12A is a side view of another exemplary embodiment of a rolling assembly for packaging web material in accordance with the disclosed subject matter with the iris in a first condition.

For purpose of illustration, and not limitation, reference is made to the exemplary embodiment of an assembly 1600 shown in FIG. 12A and FIG. 12B. In accordance with another aspect of the disclosed subject matter, assembly 1600 includes a base member 1610, a first intermediate member 1620 moveably coupled to the base member 1610, and a top member 1630 moveably coupled to at least one of the base member 1610 or the first intermediate member 1620. As embodied herein, the top member 1630 can be pivotally connected to the base member 1610. The base member 1610 includes a concave arcuate feed surface 1605 defining an upwardly-extending ramp, and the top member 1630 includes a concave arcuate pressure surface 1635 facing the arcuate feed surface 1605. The base member 1610, first intermediate member 1620, and the top member 1630 collectively form an iris 1650 with a feed space 1651 defined between the feed surface 1605 and the pressure surface 1635. Iris 1650 is depicted in broken line in FIGS. 12A and 12B for purpose of illustration only.

The iris 1650 is moveable between a first condition and a second condition. With reference to FIG. 12A, the exemplary assembly 1600 is depicted with the iris 1650 in the first condition. The feed space 1651 has a first cross dimension in side view between the feed surface 1605 and the pressure surface 1635 in the first condition. With reference to FIG. 12B, the assembly 1600 is depicted in a second condition. The feed space 1651 has a second cross dimension in side view between the feed surface 1605 and the pressure surface 1635 in the second condition, the second cross dimension being greater than the first cross dimension. For purpose of example and as embodied herein, the second cross dimension can be approximately 2.5 inches. In accordance with another aspect of the disclosed subject matter, and as embodied herein, the assembly 1600 can include one or more features to adjust the size of the second cross dimension. For example, and as embodied herein, a stop 1612 can be included on the base member 1610, and the stop can limit the movement of the iris when the desired cross dimension is reached.

The iris 1650 in the first condition is configured to receive web material along the feed surface 1605 and direct the web material upwardly toward the top member 1635 to form a roll within the feed space. The iris 1650 is configured to move toward the second condition as the roll of web material increases in cross dimension against the pressure surface 1635 of the top member.

As embodied herein, the first intermediate member 1620 can include an arcuate first intermediate pressure surface configured to further define the iris 1650 and apply pressure on a roll of web material as the roll increases in cross dimension and the iris 1650 expands from the first condition to the second condition. Additionally, and as further embodied herein, the assembly 1600 can include a second intermediate member 1640 moveably coupled to the base member 1610. The second intermediate member 1640 can include an arcuate second intermediate pressure surface configured to further define the iris 1650 and apply pressure on a roll of web material as the roll increases in cross dimension and the iris 1650 expands from the first condition to the second condition.

As embodied herein, the first intermediate member 1620, the second intermediate member 1640, and the top member 1630 can each be pivotally connected to the base member 1610. Additionally or alternatively, the top member 1630 and second intermediate member 1640 can each be slidably connected to the first intermediate member 1620. The slidable connections between the top member 1630, second intermediate member 1640, and first intermediate member 1620 can further define the motion of the iris 1650 as the iris moves from the first condition to the second condition. As embodied herein, the top member 1630 can include a fastener 1631, such as a bolt, screw, peg, pin, nail, or rivet, and the fastener 1631 can interface with a slot 1621 defined in the first intermediate member 1620 and a slot 1641 defined in the second intermediate member 1640 to slidably connect the top member 1630 and the second intermediate member 1640 to the first intermediate member 1620.

In accordance with another aspect of the disclosed subject matter, the top member 1630 of the exemplary rolling assembly 1600 can include a ballast 1660. For purpose of example, the top member 1630 can have a first end moveably coupled to at least one of the base member 1610 or the first intermediate member 1620 and a free end opposite the first end. The free end can include the ballast. As embodied herein, the first end of the top member 1630 can be pivotally connected to the base member 1610. As described above, the location and size of the ballast 1660 can be selected based on the desired performance characteristics of the assembly and the properties of the web material being rolled.

In accordance with the disclosed subject matter, the base member 1610, intermediate members 1620 and 1640, and top member 1630 can be made of any suitable material using any suitable method of manufacture. For purpose of example, and not limitation, the members can be made of metal, such as steel or aluminum, polycarbonate, composites, such as cast polyurethane or plastic sheet materials such as Lexan and UHMWPE, or any other suitable material. In accordance with another aspect of the disclosed subject matter, and as embodied herein, the base member 1610 can be made of steel and the top member 1630, first intermediate member 1620, and second intermediate member 1640, can be molded from composite material.

Furthermore, the members can be coated or partially coated with desired materials to enhance performance, such as by reducing friction or increasing durability. For example, materials like Teflon and the like can be applied to reduce friction. Teflon can be applied or partially applied to the feed surface 1605 and/or pressure surface 1635 to reduce friction between the respective surface and web material to be rolled. The material selected for the various members can be chosen based on the desired performance characteristics of the rolling assembly. For example, selecting heavier materials for the top member can increase the pressure applied to the roll as the roll increases in cross dimension and the iris 1650 moves from a first condition to a second condition. Additionally, the material may be selected to achieve a desirable coefficient of friction between the members and the web material. For example the material of the members can be selected to prevent creation of scuffs or marks on the web as the material is rolled. In accordance with one aspect of the disclosed subject matter, the base member, intermediate members, and top member can be made of different materials from one another to achieve the desired performance characteristics.

In accordance with the disclosed subject matter, the rolling assemblies for packaging web material in a roll described herein can be configured to receive web material 20 from a wide variety of delivery sources. As embodied herein, and with reference to the exemplary embodiment depicted in FIG. 8A-FIG. 8C, the iris 500 can be configured to receive a stream of web material from a feed assembly, such as a delivery belt or the like. For example, the feed assembly can be a vacuum belt, and a negative pressure can be used to keep the web material 20 secured to the belt as the belt transports the web material 20. As embodied herein, as the iris 500 receives the web material 20 from the vacuum belt and directs the web material 20 from the first end 101 upwardly towards the top member 300, the web material 20 can be released from the vacuum belt. The characteristics of the vacuum belt, such as the amount of negative pressure applied and the speed with which the vacuum belt delivers web material 20 to the iris 500, can be selected as desired for the web material to be delivered. For purpose of example and as embodied herein, approximately 60 inches H20 of negative pressure can be applied to the web material.

The rolling assemblies for packaging web material in a roll can be used with a wide variety, types, and sizes of web material in accordance with the disclosed subject matter. For purpose of example, and not limitation, the web material can include polymeric packages, such as plastic bags or the like, or other stock materials, such as paper or cloth. Furthermore, the web material can include any suitable material, including paper, plastics, or composites. For example, the material can include polyethylene or polypropylene. As embodied herein, the web material of the disclosed subject matter can include plastic bags having a resealable closure mechanism, such as described in U.S. Pat. No. 6,450,686, the contents of which are hereby incorporated by reference in their entirety. For purpose of illustration, the web material, such as plastic bags, can be delivered to the iris 500 of the rolling assembly in a shingled arrangement. With reference to FIG. 8A, the leading edge 21 of the web material 20 can include a first plastic bag, and a second plastic bag 23 can be positioned on top of the first plastic bag in a partially overlapping configuration such that a leading edge of the first bag is exposed. A third bag can be positioned on top of the second bag, and so on to create a shingled arrangement of bags.

In accordance with another aspect of the disclosed subject matter, a system for packaging web material in a roll is provided. The system includes a feed assembly configured to carry a stream of web material and a rolling assembly proximate the feed assembly and configured to receive the stream of web material from the feed assembly. In accordance with the disclosed subject matter, the rolling assembly used with the system can be configured in accordance with any of the embodiments as described above or variations thereof. The rolling assembly includes a base member with a concave arcuate feed surface defining an upwardly-extending ramp and a first intermediate member moveably coupled to the base member. The assembly further includes a top member moveably coupled to at least one of the base member or the first intermediate member. The top member has a concave arcuate pressure surface facing the feed surface of the base member. The base member, the first intermediate member and the top member collectively form an iris with a feed space defined between the feed surface and the pressure surface. The iris is moveable between a first condition and a second condition, and the feed space has a first cross dimension in side view between the feed surface and the pressure surface in the first condition. The feed space has a second cross dimension in side view between the feed surface and the pressure surface when the iris is in the second condition. The second cross dimension is greater than the first cross dimension. The iris is configured in the first condition to receive web material along the feed surface and direct the web material upwardly toward the top member to form a roll within the feed space. The iris moves toward the second condition as the roll of web material increases in cross dimension against the pressure surface of the top member.

Figure 13:
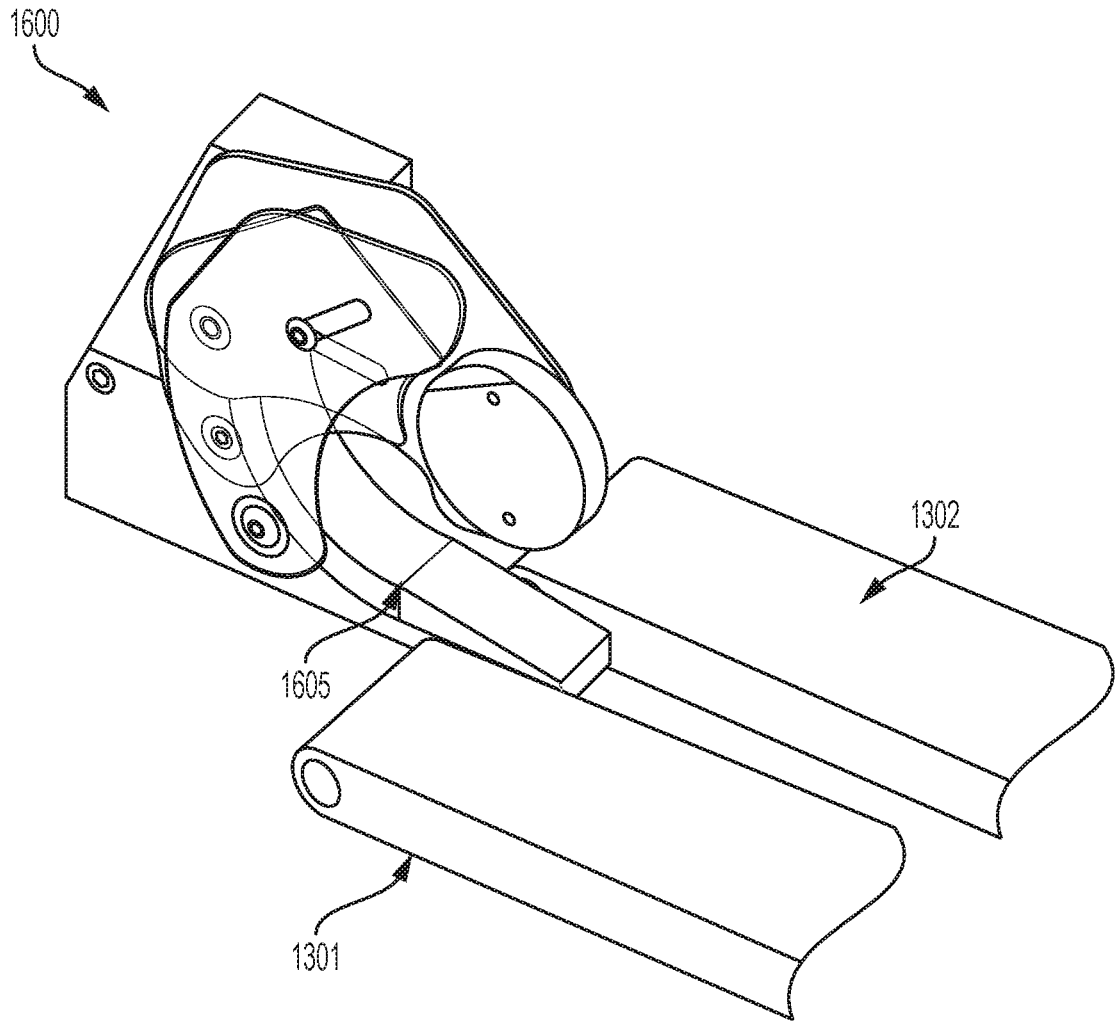
FIG. 13 is a perspective view of the rolling assembly of FIG. 12A and a feed assembly for delivering web material to the rolling assembly.
Figure 14:
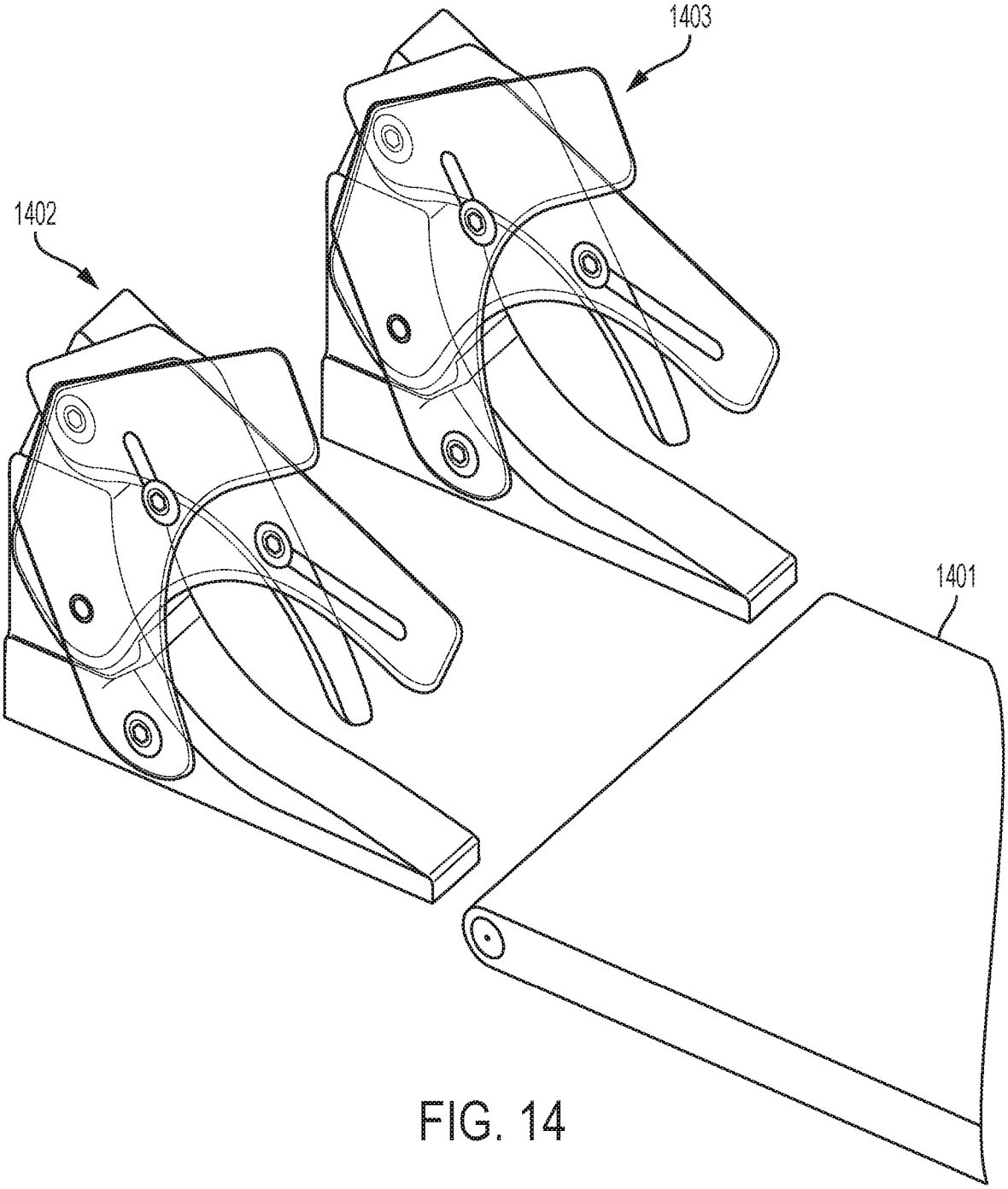
FIG. 14 is a perspective view of two exemplary rolling assemblies in accordance with the disclosed subject matter arranged in a parallel configuration and a feed assembly for delivering web material to the rolling assemblies.

In accordance with another aspect of the disclosed subject matter, and with reference to the exemplary embodiment of FIG. 13, the feed assembly can include two vacuum belts 1301 and 1302 with a space therebetween, and the rolling assembly 1600 can be disposed in the space. A stream of web material, such as a plurality of plastic bags in a shingled arrangement, can be carried on the vacuum belts 1301 and 1302 to the rolling assembly 1600. As embodied herein, the feed surface 1605 of the assembly 1600 can be positioned to receive the stream of web material from the vacuum belts 1301 and 1302. Additionally or alternatively, the feed assembly can be integrated with the base member 1610.

In accordance with another aspect of the disclosed subject matter, the rolling assembly 1600 can be mounted to a rotatable carriage assembly. For example, multiple rolling assemblies can be mounted to the carriage assembly. When a roll of web material is completed in the rolling assembly 1600, the carriage assembly can rotate the rolling assembly 1600 away from the feed assembly to a position for extracting the completed roll from the rolling assembly. As the rolling assembly 1600 is rotated away from the feed assembly, the carriage assembly can rotate a second rolling assembly into place to receive a stream of web material from the feed assembly.

The rolling assembly, system, and method can be used with a variety of sizes of web material. For example, and with reference to the exemplary embodiment of FIG. 14, a plurality of rolling assemblies can be aligned in parallel to package wider webs in a roll. As embodied herein, the system for packaging web material in a roll can include a first rolling assembly 1402 and a second rolling assembly 1403 disposed proximate the feed assembly 1401 and configured to receive a stream of web material. The second rolling assembly can be used in tandem with the first rolling assembly to efficiently package web material in a roll depending on the properties of the web material to be packaged. For example, wide sheets of web material may benefit from the use of more than one rolling assembly.

As embodied herein, the second rolling assembly 1403 can have the same configuration as the first rolling assembly 1402. Alternatively, and in accordance with another aspect of the disclosed subject matter, the second rolling assembly 1403 can have a different configuration from the first rolling assembly 1402. For example, rolling assemblies 1402 and 1403 having different iris cross-dimensions can be configured side by side to accommodate rollups having different diameters along the length of the roll. For example rolls of slider bags can include a larger diameter at the portion of the roll having the bag sliders and a smaller diameter at the portion of the roll without sliders. While the above description refers to the use of one or two rolling assemblies, any suitable number of rolling assemblies can be used.

In accordance with another aspect of the disclosed subject matter, a method of packaging web material in a roll is provided. The method includes providing a rolling assembly configured to receive a stream of web material. In accordance with the disclosed subject matter, the rolling assembly provided can be configured in accordance with any of the embodiments as described above or variations thereof. The rolling assembly includes a base member with a concave arcuate feed surface defining an upwardly-extending ramp and a first intermediate member moveably coupled to the base member. The assembly further includes a top member moveably coupled to at least one of the base member or the first intermediate member. The top member has a concave arcuate pressure surface facing the feed surface of the base member. The base member, the first intermediate member and the top member collectively form an iris with a feed space defined between the feed surface and the pressure surface. The iris is moveable between a first condition and a second condition, and the feed space has a first cross dimension in side view between the feed surface and the pressure surface in the first condition. The feed space has a second cross dimension in side view between the feed surface and the pressure surface when the iris is in the second condition. The second cross dimension is greater than the first cross dimension.

Methods in accordance with the disclosed subject matter further include delivering a stream of web material to the assembly. The iris receives the web material along the feed surface and directs the web material upwardly toward the top member to form a roll within the feed space. The iris moves toward the second condition as the roll of web material increases in cross dimension against the pressure surface of the top member.

In accordance with another aspect of the disclosed subject matter, delivering the stream of web material can include delivering a plurality of plastic bags in a shingled arrangement.

The assemblies, systems, and methods of the disclosed subject matter have demonstrated desirable performance characteristics not achieved with conventional devices and techniques. For example, currently known rolling assemblies are designed to maintain the final outside diameter of the roll of web material, but known assemblies do not maintain pressure on the roll of web material as the web material expands in cross dimension throughout the rolling process. As such, rolls of web material produced using known assemblies and methods can be less tightly rolled and have a larger final cross dimension for a given amount of web material than rolls produced according to the disclosed subject matter. Less tightly rolled web material can be less desirable, as the rolls with larger final cross dimension can require additional space for storage, transport, and commercialization. By contrast, rolling assemblies in accordance with the disclosed subject matter include an iris that is moveable between a first condition and a second condition, and a feed space defined between the feed surface of the base member and the pressure surface of the top member. As the roll of web material increases in cross dimension against the pressure surface of the top member, the iris maintains pressure on the roll of web material as the iris moves from the first condition to the second condition. As such, the rolling assemblies, systems, and methods in accordance with the disclosed subject matter can produce tighter rolls of web material than previously known rolling assemblies.

Although the rolling assemblies herein are depicted in an orientation with the top member disposed above the base member such that gravity acts on the top member to bias the pressure surface of the top member towards the feed surface of the base member, it is to be understood that alternative configurations are envisioned within the scope of the disclosed subject matter. For example and not limitation, the pressure surface can be biased towards the feed surface with a spring, air cylinder, electric motor, or other mechanical or magnetic means.

In addition to the specific embodiments claimed below, the disclosed subject matter is also directed to other embodiments having any other possible combination of the dependent features claimed below and those disclosed above. As such, the particular features presented in the dependent claims and disclosed above can be combined with each other in other manners within the scope of the disclosed subject matter such that the disclosed subject matter should be recognized as also specifically directed to other embodiments having any other possible combinations. Thus, the foregoing description of specific embodiments of the disclosed subject matter has been presented for purposes of illustration and description. It is not intended to be exhaustive or to limit the disclosed subject matter to those embodiments disclosed.

It will be apparent to those skilled in the art that various modifications and variations can be made in the assemblies, systems, and methods of the disclosed subject matter without departing from the spirit or scope of the disclosed subject matter. Thus, it is intended that the disclosed subject matter include modifications and variations that are within the scope of the appended claims and their equivalents.

The invention claimed is:

1. A rolling assembly for packaging web material in a roll, comprising:

a base member having a concave arcuate feed surface defining an upwardly-extending ramp;

a first intermediate member movably coupled to the base member, the first intermediate member including an arcuate first intermediate pressure surface; and a top member moveably coupled to at least one of the base member or the first intermediate member, the top member having a concave arcuate pressure surface facing the feed surface of the base member;

wherein the base member, the first intermediate member and the top member collectively form an iris with a feed space defined between the feed surface and the pressure surface, the iris being moveable between a first condition and a second condition, the feed space having a first cross dimension in side view between the feed surface and the pressure surface in the first condition and a second cross dimension in side view between the feed surface and the pressure surface in the second condition, the second cross dimension being greater than the first cross dimension, and the iris being configured in the first condition to receive web material along the feed surface and direct the web material upwardly toward the top member to form a roll within the feed space, the iris configured to move toward the second condition as the roll of web material increases in cross dimension against the pressure surface of the top member, the arcuate first intermediate pressure surface configured to further define the iris and apply pressure on the roll as the roll increases in cross dimension and the iris expands from the first condition to the second condition.

2. The rolling assembly of claim 1, wherein the first intermediate member is pivotally connected to the base member.

3. The rolling assembly of claim 1, further comprising a second intermediate member moveably coupled to the base member, the second intermediate member having an arcuate second intermediate pressure surface configured to further define the iris and apply pressure on the roll as the roll increases in cross dimension and the iris expands from the first condition to the second condition.

4. The rolling assembly of claim 3, wherein the first intermediate member, the second intermediate member, and the top member are each pivotally connected to the base member.

5. The rolling assembly of claim 3, wherein the top member and second intermediate member are each slidably connected to the first intermediate member.

6. The rolling assembly of claim 5, wherein the top member includes a first fastener and the first intermediate member includes a first slot, the first fastener interfacing with the first slot to slidably connect the top member and the first intermediate member.

7. The rolling assembly of claim 1, wherein the base member includes a stop, the stop configured to prevent further movement of the pressure surface away from the feed surface when the iris is in the second condition.

8. The rolling assembly of claim 1, wherein the top member includes a first end moveably coupled to at least one of the base member or the first intermediate member and a free end opposite the first end, the free end having a ballast.

9. The rolling assembly of claim 1, wherein the iris is configured to receive a stream of web material from a vacuum belt.

10. The rolling assembly of claim 1, wherein the web material includes a plurality of plastic bags in a shingled arrangement.

11. The rolling assembly of claim 1, wherein the material of the top member is selected from the group consisting of steel, aluminum, urethane or polycarbonate.

12. The rolling assembly of claim 1, wherein the pressure surface comprises Teflon.

13. A system for packaging web material in a roll comprising:

a feed assembly configured to carry a stream of web material;

a rolling assembly proximate the feed assembly and configured to receive a stream of web material from the feed assembly, the rolling assembly comprising:

a base member having a concave arcuate feed surface defining an upwardly-extending ramp;

a first intermediate member moveably coupled to the base member, the first intermediate member including an arcuate first intermediate pressure surface; and a top member moveably coupled to at least one of the base member and the first intermediate member, the top member having a concave arcuate pressure surface facing the feed surface of the base member;

wherein the base member, the first intermediate member and the top member collectively form an iris with a feed space defined between the feed surface and the pressure surface, the iris being moveable between a first condition and a second condition, the feed space having a first cross dimension in side view between the feed surface and the pressure surface in the first condition and a second cross dimension between the feed surface and the pressure surface in the second condition, the second cross dimension being greater than the first cross dimension, and the iris being configured in the first condition to receive web material along the feed surface from the feed assembly and direct the web material upwardly toward the top member to form a roll within the feed space, the iris moving toward the second condition as the roll of web material increases in cross dimension against the pressure surface of the top member the arcuate first intermediate pressure surface configured to further define the iris and apply pressure on the roll as the roll increases in cross dimension and the iris expands from the first condition to the second condition.

14. The system of claim 13, wherein the feed assembly comprises a vacuum belt.

15. The system of claim 13, wherein the feed assembly comprises two vacuum belts with a space therebetween, and wherein the rolling assembly is disposed in the space.

16. The system of claim 15 wherein the stream of web material includes a plurality of plastic bags in a shingled arrangement.

17. The system of claim 13, further comprising a second rolling assembly proximate the feed assembly and configured to receive the stream of web material.

18. The system of claim 13, wherein the base member includes a stop, the stop configured to prevent further movement of the pressure surface away from the feed surface when the iris is in the second condition.

19. A method for packaging web material in a roll, the method comprising:

providing a rolling assembly configured to receive a stream of web material, the rolling assembly comprising:

a base member having a concave arcuate feed surface defining an upwardly-extending ramp;

a first intermediate member moveably coupled to the base member; and a top member moveably coupled to at least one of the base member and the first intermediate member, the top member having a concave arcuate pressure surface facing the feed surface of the base member;

wherein the base member, the first intermediate member and the top member collectively form an iris with a feed space defined between the feed surface and the pressure surface, the iris being moveable between a first condition and a second condition, the feed space having a first cross dimension in side view between the feed surface and the pressure surface in the first condition and a second cross dimension between the feed surface and the pressure surface in the second condition, the second cross dimension being greater than the first cross dimension; and delivering a stream of web material including a plurality of plastic bags in a shingled arrangement to the assembly, the iris receiving the web material along the feed surface and directing the web material upwardly toward the top member to form a roll within the feed space, the iris moving toward the second condition as the roll of web material increases in cross dimension against the pressure surface of the top member.

20. The method of claim 19, wherein the first intermediate member includes an arcuate first intermediate pressure surface configured to further define the iris and apply pressure on the roll as the roll increases in cross dimension and the iris expands from the first condition to the second condition.

* * * * *